US006696235B2

(12) United States Patent
Miki

(10) Patent No.: US 6,696,235 B2
(45) Date of Patent: Feb. 24, 2004

(54) SILVER HALIDE PHOTOGRAPHIC EMULSION AND SILVER HALIDE PHOTOGRAPHIC LIGHTSENSITIVE MATERIAL CONTAINING THE SAME

(75) Inventor: Masaaki Miki, Minami-Ashigara (JP)

(73) Assignee: Fuji Photo Film Co., Ltd., Minami-Ashigara (JP)

( * ) Notice: Subject to any disclaimer, the term of this patent is extended or adjusted under 35 U.S.C. 154(b) by 0 days.

(21) Appl. No.: 09/804,189

(22) Filed: Mar. 13, 2001

(65) Prior Publication Data

US 2001/0038983 A1 Nov. 8, 2001

(30) Foreign Application Priority Data

Mar. 13, 2000 (JP) ..... 2000-068796

(51) Int. Cl.[7] ..... G03C 1/035
(52) U.S. Cl. ..... 430/567; 430/569
(58) Field of Search ..... 430/567, 569

(56) References Cited

U.S. PATENT DOCUMENTS 4,806,461 A 2/1989 Ikeda et al.
5,498,516 A * 3/1996 Kikuchi et al. ..... 430/567
5,614,358 A * 3/1997 Wilson et al. ..... 430/567
5,650,266 A * 7/1997 Taguchi et al. ..... 430/567
5,709,988 A 1/1998 Black et al.
5,726,007 A * 3/1998 Deaton et al. ..... 430/567
6,030,758 A * 2/2000 Nomiya ..... 430/506
6,080,535 A * 6/2000 Kondo ..... 430/567

* cited by examiner

*Primary Examiner*—Janet Baxter
*Assistant Examiner*—Amanda C. Walke
(74) *Attorney, Agent, or Firm*—Birch, Stewart, Kolasch & Birch, LLP

(57) ABSTRACT

A silver halide photographic emulsion comprising silver halide grains, wherein 50% or more of the total number of all the silver halide grains are occupied by tabular grains satisfying the following requirements (i) composed of silver iodobromide or silver chloroiodobromide, and having (111) faces as main planes, (ii) having an equivalent circle diameter of 1.0 $\mu$m or more and a thickness of 0.1 $\mu$m or less, (iii) having 10 or more dislocation lines at a fringe portion thereof, and (iv) composed of a core portion substantially not containing any dislocation line and a shell portion containing dislocation lines, and the shell portion having a thickness of 0.01 $\mu$m or more as measured in a direction perpendicular to the main plane.

21 Claims, No Drawings

SILVER HALIDE PHOTOGRAPHIC EMULSION AND SILVER HALIDE PHOTOGRAPHIC LIGHTSENSITIVE MATERIAL CONTAINING THE SAME

CROSS-REFERENCE TO RELATED APPLICATIONS

This application is based upon and claims the benefit of priority from the prior Japanese Patent Application No. 2000-068796, filed Mar. 13, 2000, the entire contents of which are incorporated herein by reference.

BACKGROUND OF THE INVENTION

The present invention relates to a silver halide photographic emulsion and a silver halide photographic lightsensitive material containing the same. More particularly, the present invention relates to a highly sensitive silver halide photographic emulsion ensuring a reduction of pressure mark deterioration and a silver halide photographic lightsensitive material containing the same.

With respect to tabular silver halide grains, for example, U.S. Pat. Nos. 4,434,226, 4,439,520, 4,414,310, 4,433,048, 4,414,306 and 4,459,353 disclose processes for producing the same and techniques for use thereof. These teach advantages such as enhancement of sensitivity/graininess relations, including enhancement of spectral sensitization efficiency, attained by the use of spectral sensitizing dyes.

Various investigations and studies have been made with a view toward further enhancing the performance of tabular grains capable of realizing the above advantages.

Japanese Patent Application KOKAI Publication No. (hereinafter referred to as JP-A-) 63-220238, whose corresponding US application is patented as U.S. Pat. No. 4,806,461, discloses the technique for attaining a sensitivity increase and an improvement of pressure performance by introduction of dislocation lines. However, introducing dislocation lines in thin tabular grains with a large equivalent circle diameter at a high density is difficult. Therefore, it is difficult to realize satisfactory performance with respect to sensitivity increase and pressure characteristics with the use of the technique.

BRIEF SUMMARY OF THE INVENTION

An object of the present invention is to provide a highly sensitive silver halide photographic emulsion ensuring a reduction of pressure marks, and a silver halide photographic lightsensitive material containing the same.

The object of the present invention is attained by the following silver halide photographic emulsion and silver halide photographic lightsensitive material containing the same.

(I) A silver halide photographic emulsion comprising silver halide grains, wherein 50% in number or more of the total number of all the silver halide grains are occupied by tabular grains, each of which satisfying the following requirements:

(i) composed of silver iodobromide or silver chloroiodobromide having (111) faces as main planes;

(ii) having an equivalent circle diameter of 1.0 $\mu$m or more and a thickness of 0.1 $\mu$m or less;

(iii) having 10 or more dislocation lines per grain at a fringe portion thereof; and (iv) composed of core portion substantially not containing any dislocation line and a shell portion containing dislocation lines, the shell portion having a thickness of 0.01 $\mu$m or more as measured in a direction perpendicular to the main plane.

(II) The silver halide photographic emulsion according to item (I) above, wherein the thickness of the shell portion is 0.015 $\mu$m or more.

(III) The silver halide photographic emulsion according to item (I) or (II) above, wherein a variation coefficient of the distribution of equivalent circle diameters of all the silver halide grains contained in the silver halide photographic emulsion is 30% or less.

(IV) The silver halide photographic emulsion according to item (III) above, wherein a variation coefficient of the distribution of thicknesses of all the silver halide grains contained in the silver halide photographic emulsion is 20% or less.

(V) A silver halide photographic lightsensitive material comprising at least one lightsensitive silver halide emulsion layer on a support, wherein the lightsensitive silver halide emulsion layer contains the silver halide photographic emulsion according to any of items (I) to (IV) above.

DETAILED DESCRIPTION OF THE INVENTION

Now, the emulsion of the present invention will be described.

The tabular grains for use in the present invention are composed of a silver halide containing silver iodide, more specifically, silver iodobromide or silver chloroiodobromide.

In the present invention, the tabular grains refer to silver halide grains having two mutually opposite and parallel (111) main planes. The tabular grains used in the present invention have one twin plane or two or more mutually parallel twin planes. The twin plane refers to the (111) surface on both sides of which the ions of all the lattice points are in the relationship of reflected images.

The tabular grains, as viewed from a point perpendicular to the main plane of the tabular grains, have the shape of a triangle, a hexagon or an intermediate triangle with angle portions cut off. The tabular grains have mutually parallel external surfaces.

The silver halide grains not comprehended in the tabular grains include regular crystal grains and grains having two or more nonparallel twin planes. The grains having two nonparallel twin planes include those having the shape of a trigonal pyramid or a rod. These are collectively referred to as "nontabular grains".

In the measurement of the equivalent circle diameter and thickness of the tabular grains, a transmission electron micrograph according to the replica method is taken, from which the diameter of a circle having the same area as the projected area of each individual grain (equivalent circle diameter) and the thickness thereof are determined. The thickness is calculated from the length of the shadow of the replica. With respect to the nontabular grains, the equivalent circle diameter is defined as the diameter of a circle having the same area as the maximized projected area of each individual grain. When there is no plane parallel to a base as encountered in, for example, grains having the shape of a trigonal pyramid among the nontabular grains, the thickness of the grains is defined as the distance between the base and the apex thereof.

The nontabular grains are not favorable because the specific surface area thereof is so small that using them at a high proportion causes it difficult to attain a sensitivity increase.

With respect to the silver halide grains contained in the silver halide photographic emulsion of the present invention, tabular grains having an equivalent circle diameter of 1.0 μm or more and a thickness of 0.1 μm or less occupy 50% or more of the total number of all the silver halide grains.

When the equivalent circle diameter is decreased, the grain size is decreased to thereby cause attaining a sensitivity increase to be difficult. When the thickness is increased, the specific surface area is decreased to thereby cause keeping the ratio of sensitivity/graininess high to be difficult. With respect to the silver halide photographic emulsion of the present invention, 50% or more of the total number of all the silver halide grains contained therein have an equivalent circle diameter of 1.0 μm or more and a thickness of 0.1 μm or less, preferably an equivalent circle diameter of 1.0 μm or more and a thickness of 0.07 μm or less, and more preferably an equivalent circle diameter of 1.5 μm or more and a thickness of 0.07 μm or less. Provided that, however, it is preferred that the equivalent circle diameter be 5 μm or less and the thickness be 0.03 μm or more.

In the chemical sensitization of silver halide grains, nonuniformity between grains in, for example, the size thereof causes attaining the optimum sensitization of the individual grains to be difficult, thereby inviting a deterioration of photographic sensitivity. From this viewpoint, it is preferred that the equivalent circle diameter and thickness of tabular grains be monodisperse.

With respect to all the silver halide grains of the present invention, the variation coefficient of equivalent circle diameter is preferably 30% or less, more preferably 25% or less The variation coefficient of thickness is preferably 20% or less. The terminology "variation coefficient of equivalent circle diameter (%)" used herein means the value obtained by dividing a standard deviation of equivalent circle diameters of individual silver halide grains by an average equivalent circle diameter and by multiplying the quotient by 100. On the other hand, the terminology "variation coefficient of thickness (%)" used herein means the value obtained by dividing a standard deviation of thicknesses of individual silver halide grains by an average thickness and by multiplying the quotient by 100.

With respect to the silver halide emulsion of the present invention, 50% or more of the total number of silver halide grains contained therein consist of tabular grains having an aspect of 10 or more, preferably 15 or more, and more preferably 20 or more. The terminology "aspect ratio" used herein means the quotient of the equivalent circle diameter of grain divided by the grain thickness.

The twin plane spacing of the tabular grains is preferably 0.014 μm or less, more preferably 0.012 μm or less. In the case where three or more twin planes, the twin plane spacing herein means the distance between two twin planes having the longest distance in each grain.

In the formation of fringe dislocation grains, uniformity of the side portion of tabular grains is important because it influences the uniformity of fringe dislocation between individual grains. From this viewpoint, with respect to the twin plane spacing, it is preferred that the variation coefficient of twin plane spacing of tabular grains be 40% or less, especially 30% or less. The terminology "fringe dislocation grains" used herein means grains having dislocation lines at a fringe portion thereof as viewed from a point perpendicular to the main plane of the grains. The term "fringe portion" of a grain herein means the outside area of an imaginary circle having a center thereof at the center of the grain and having a radius whose length is 60% of a shortest perpendicular line among perpendicular lines drawn from the center of the grain to each side of the grain.

The tabular silver halide grains having (111) faces as main planes generally have the shape of a hexagon, a triangle or an intermediate between the hexagon and the triangle with angle portions of the triangle cut off, and have three-fold symmetry. With respect to the shape having six sides, the ratio of the sum of the lengths of three relatively long sides to the sum of the lengths of three relatively short sides is referred to as the ratio of long side/short side. The triangle with angle portions cut off refers to a triangle having the shape resulting from cutting of the apex portions of the triangle with straight lines to thereby remove the triangular apex portions containing the apex. With respect to the tabular grains, causing the ratio of long side/short side thereof to approach 1 from the viewpoint of inter-granular uniformity would facilitate the optimum chemical sensitization of individual grains.

In the formation of fringe dislocation grains, it has been observed that the density of dislocation lines at the fringe portions is extremely low in the grains having the shape close to a triangle as compared with that of the grains having the shape close to a hexagon. From this viewpoint as well, causing the ratio of long side/short side of the tabular grains to approach 1 is preferred. The average of the ratio of long side/short side of the tabular grains is preferably 1.6 or less, more preferably 1.3 or less.

The preparation of the tabular grains of the present invention fundamentally comprises a combination of three steps consisting of nucleation, ripening and growth. The methods described in U.S. Pat. No. 4,797,354 and JP-A-2-838 can be consulted in the preparation of the tabular grains of the present invention.

In the nucleation step for preparing the tabular grains used in the emulsion of the present invention, it may be effective to use gelatins of low methionine content as described in U.S. Pat. Nos. 4,713,320 and 4,942,120; to carry out nucleation at high pBr as described in U.S. Pat. No. 4,914,014; and to carry out nucleation within a short period of time as described in JP-A-2-222940. In the step of ripening of the tabular grains used in the emulsion of the present invention, it may be effective to carry out the ripening in the presence of a low-concentration base as described in U.S. Pat. No. 5,254,453 and to carry out the ripening at high pH as described in U.S. Pat. No. 5,013,641.

The gelatin whose molecular weight has been reduced by enzymolysis exhibits a deteriorated protective colloid capacity for silver halide grains. It is feared that further deterioration of the protective colloid capacity by oxidation would cause the adsorptive power onto silver halide to be so low that, in the use in the nucleation, the probability of twinned crystal formation cannot be fully controlled. Experiments have, however, demonstrated that, even if a gelatin whose molecular weight has been reduced to 15,000 is oxidized to a methionine content of 3.4 μmol/g, the requisite protective colloid capacity is retained.

The molecular weight of the oxidized low-molecular-weight gelatin is preferably 40,000 or less, more preferably 30,000 or less, and most preferably 20,000 or less.

The methionine content of the above gelatin is preferably 10 μmol/g or less, more preferably 4 μmol/g or less.

The method of forming tabular grains with the use of polyalkylene oxide compounds as described in U.S. Pat. Nos. 5,147,771, 5,147,772, 5,147,773, 5,171,659, 5,210,013 and 5,252,453 is preferably utilized in the preparation of the tabular grains of the present invention.

The growth of tabular grains is generally performed by adding an aqueous solution of silver nitrate and an aqueous solution of halides containing an iodide and a bromide by the double jet method. In place of the addition of an aqueous solution of silver nitrate and an aqueous solution of halides containing an iodide and a bromide by the double jet method, it is effective to simultaneously add an aqueous solution of silver nitrate, an aqueous solution of halides including a bromide and an emulsion of silver iodide fine grains as described in U.S. Pat. Nos. 4,672,027 and 4,693,964. Furthermore, it is feasible to carry out the grain growth by adding an emulsion of silver iodobromide fine grains and conducting ripening thereof. In this instance, a silver halide solvent is preferably used.

Examples of silver halide solvents which can be used in the present invention include (a) organic thioethers described in U.S. Pat. Nos. 3,271,157, 3,531,286 and 3,574,628, JP-A's 54-1019 and 54-158917; (b) thiourea derivatives described in JP-A's 53-82408, 55-77737 and 55-2982; (c) silver halide solvents having a thiocarbonyl group interposed between an oxygen or sulfur atom and a nitrogen atom described in JP-A-53-144319; (d) imidazoles described in JP-A-54-100717; (e) sulfites ; (f) ammonia and (g) thiocyanates.

Especially preferred solvents are thiocyanates, ammonia and tetramethylthiourea. Although the amount of added solvent depends on the type thereof, in the case of, for example, a thiocyanate, the preferred amount is in the range of $1\times10^{-4}$ to $1\times10^{-2}$ mol per mol of silver halide. In the use of any solvent, the solvent can basically be removed by providing the washing step.

In the present invention, the tabular grains have dislocation lines. The dislocation lines of tabular grains can be observed by the direct method using a transmission electron microscope at low temperatures as described in, for example, J. F. Hamilton, Phot. Sci. Eng., 11, 57 (1967) and T. Shiozawa, J. Soc. Phot. Sci. Japan, 35, 213 (1972). Illustratively, silver halide grains are harvested from the emulsion with the care that the grains are not pressurized with such a force that dislocation lines occur on the grains, are put on a mesh for electron microscope observation and, while cooling the specimen so as to prevent damaging (printout, etc.) by electron beams, are observed by the transmission method. The greater the thickness of the above grains, the more difficult the transmission of electron beams. Therefore, the use of an electron microscope of high voltage type (at least 200 kV on the grains of 0.25 $\mu$m in thickness) is preferred for ensuring clearer observation. The thus obtained photograph of grains enables determining the position and number of dislocation lines in each grain viewed in the direction perpendicular to the main planes.

With respect to the silver halide grains of the present invention, 50% or more of the total number of silver halide grains are occupied by tabular grains having, at the fringe portions thereof, 10 or more, preferably 20 or more, and more preferably 30 or more dislocation lines per grain.

The introduction of dislocation in the tabular grains of the present invention is carried out in the following manner. Specifically, the dislocation is introduced by an epitaxial growth of silver halide on fringe portions of base tabular grains substantially not containing dislocation lines (also referred to as "core particles"), followed by formation of a silver halide shell. The expression "core portions substantially not containing dislocation lines" used herein means that the number of dislocation lines at the core portions is much smaller than the number of dislocation lines at the finally obtained fringe portions, for example, not greater than ⅓ of the latter number.

The silver iodide content of the core particles is preferably in the range of 0 to 12 mol %, more preferably 0 to 10 mol %.

The silver halide for use in the epitaxial growth on the core particles (portions) can be any of silver iodide, silver iodobromide, silver chloroiodobromide and silver chloroiodide. However, among these, silver iodide or silver iodobromide (silver iodide content: 10 to 40 mol %) is preferred. Silver iodide is more preferred. It is preferred that the above epitaxial growth occur on side portions of the core particles.

The amount of halogen added in the epitaxial growth is preferably in the range of 0.1 to 20 mol %, more preferably 0.5 to 10 mol %, and most preferably 1 to 5 mol %, based on the core particles.

The subsequent addition of $AgNO_3$ and halogen to thereby grow a silver halide shell realizes the introduction of dislocation.

The silver iodide content of silver halide shell is preferably in the range of 0 to 12 mol %, more preferably 0 to 10 mol %, and most preferably 0 to 3 mol %.

In the above step of dislocation introduction, the pAg is preferably in the range of 6.4 to 10.5, and the temperature is preferably in the range of 30 to 80° C.

The tabular grains having dislocation lines at fringe portions are formed in the above manner. The portions having originally been core particles constitute core portions, and thus the core portions contain substantially no dislocation lines. The portions formed after the epitaxial growth of silver halide on the core particles constitute shell portions. The shell portions have dislocation lines mainly at the fringe portions.

The core portions and the shell portions can be distinguished from each other by observing an extremely thin section of tabular grains through a transmission electron microscope, and hence the shell thickness can be measured. The extremely thin section can be obtained by first applying a silver halide photographic emulsion onto a support so as to produce a specimen comprising tabular grains arranged on the support in substantially parallel relationship to the support and thereafter cutting the specimen to a thickness of about 0.06 $\mu$m by means of a diamond knife.

When an extremely thin section of tabular grains having dislocation lines introduced in the fringe portions is observed through a transmission electron microscope, generally four contrast straight lines parallel to the main plane are recognized. These are classified into two lines close to the grain surface and two inner lines.

The two inner lines are attributed to twin planes. Most of the tabular grains contain two twin planes, so that the two lines are observed in accordance with the two twin planes. In such rare cases that there are three twin planes, three lines are observed in accordance therewith. In these cases, five lines are observed on an extremely thin section of the tabular grains.

The two lines close to the main plane are attributed to the step of epitaxial growth of silver halide on fringe portions at the time of dislocation introduction. The silver halide for use in the epitaxial growth has a silver iodide content higher than that of the core particles and is grown under such conditions that deposition occurs mainly on the fringe portions. Under such conditions as well, however, a small amount of a layer with high silver iodide content is also formed on the main plane portions. This layer with high silver iodide content, because of the halogen composition difference from that of the surrounding portions, is observed as straight lines. That is, on the basis of these two lines as a border, the grain inner portions and the outer surface-side portions can be identified as the core portions and the shell portions, respectively.

The shell portions are present on both the main planes of silver halide grains, and the thicknesses thereof are generally equal to each other. In the event that the thicknesses are not equal to each other, the average thereof is referred to as the shell thickness.

When the shell thickness is small, the formation of tabular grains having a satisfactory density of dislocation lines at the fringe portions is so difficult that a sensitivity deterioration due probably thereto is observed. Further, when the shell thickness is small, a conspicuous deterioration of pressure marks has been observed. As a result of investigations on the shell thickness, it has been found that the deterioration of pressure marks can be relieved by increasing the shell thickness. The shell thickness is generally 0.010 $\mu$m or more, preferably 0.015 $\mu$m or more. The shell thickness is preferably up to 0.04 $\mu$m.

The method of growing the silver halide epitaxial on the core particles will be described in greater detail below.

As the method of growing the silver halide epitaxial on the core particles, there can be employed the method in which an aqueous solution of silver nitrate and an aqueous solution of halides containing an iodide and a bromide are added by double jet and the method in which an aqueous solution of halides is added by single jet. As preferred means, there can be employed the method in which addition of a silver iodobromide or silver iodide fine grain emulsion, ripening and dissolution thereof are performed in sequence. In addition, as preferred means, the method in which a silver iodide fine grain emulsion is added, followed by addition of an aqueous solution of silver nitrate or addition of an aqueous solution of silver nitrate and an aqueous solution of halides. In this instance, the dissolution of silver iodide fine grain emulsion is accelerated by the addition of an aqueous solution of silver nitrate. It is preferred that the silver iodide fine grain emulsion be added rapidly.

The expression "rapidly adding the silver iodide fine grain emulsion" means completing the addition of the silver iodide fine grain emulsion within preferably 10 min, more preferably 7 min. Although this addition period requirement can be varied depending on the temperature, pBr and pH of addition system, type of protective colloid agent such as gelatin, concentration thereof, presence or absence of silver halide solvent, type and concentration thereof, etc., the shorter, the more preferred, as mentioned above. At the time of the addition, it is preferred substantially not to add any aqueous solution of silver salt such as silver nitrate. The temperature of the system at the time of the addition is preferably in the range of 40 to 90° C., more preferably 50 to 80° C.

The silver iodide fine grain emulsion is not limited as long as it is substantially composed of silver iodide. The silver iodide fine grain emulsion may contain silver bromide and/or silver chloride as long as a mixed crystal can be formed. The silver iodide fine grain emulsion preferably 100% consists of silver iodide. With respect to the crystalline structure, the silver iodide can have not only β phase and γ phase but also, as described in U.S. Pat. No. 4,672,026, α phase or a structure similar thereto. In the present invention, although the crystalline structure is not particularly limited, it is preferred to employ a mixture of β phase and γ phase, more preferably β phase only. Although the silver iodide fine grain emulsion may be one prepared immediately before the addition as described in, for example, U.S. Pat. No. 5,004,679, or one having undergone the conventional washing, it is preferred in the present invention to employ the silver iodide fine grain emulsion having undergone the conventional washing. The silver iodide fine grain emulsion can be easily prepared by the methods as described in, for example, U.S. Pat. No. 4,672,026. The method of adding an aqueous solution of silver salt and an aqueous solution of iodide by double jet, wherein the grain formation is carried out at a fixed pI value, is preferred. The terminology "pI" used herein means the logarithm of inverse of $I^-$ ion concentration of the system. Although there is no particular limitation with respect to the temperature, pI, pH, type of protective colloid agent such as gelatin, concentration thereof, presence or absence of silver halide solvent, type and concentration thereof, etc., it is advantageous in the present invention that the grain size be 0.1 $\mu$m or less, preferably 0.07 $\mu$m or less. Although the grain configuration cannot be fully specified because of the fine grains, it is preferred that the variation coefficient of the grain size distribution be 25% or less. When it is 20% or less, the advantage of the present invention is especially striking. The size and size distribution of the silver iodide fine grain emulsion are determined by placing silver iodide fine grains on a mesh for electron microscope observation and, not through the carbon replica method, directly making an observation according to the transmission technique. The reason is that, because the grain size is small, the observation by the carbon replica method causes a large measuring error. The grain size is defined as the diameter of a circle having the same projected area as that of observed grain. With respect to the grain size distribution as well, it is determined by the use of the above diameter of a circle having the same projected area. In the present invention, the most effective silver iodide fine grains have a grain size of 0.06 to 0.02 $\mu$m and exhibit a variation coefficient of grain size distribution of 18% or less.

After the above grain formation, the silver iodide fine grain emulsion is preferably subjected to, as described in, for example, U.S. Pat. No. 2,614,929, the conventional washing and the regulation of pH, pI and concentration of protective colloid agent such as gelatin and regulation of concentration of contained silver iodide. The pH is preferably in the range of 5 to 7. The pI value is preferably set at one minimizing the solubility of silver iodide or one higher than the same. Conventional gelatin having an average molecular weight of about 100 thousand is preferably used as the protective colloid agent. Also, low-molecular-weight gelatins having an average molecular weight of 20 thousand or less are preferably used. There are occasions in which the use of a mixture of such gelatins having different molecular weights is advantageous. The gelatin amount per kg of emulsion is preferably in the range of 10 to 100 g, more preferably 20 to 80 g. The silver quantity in terms of silver atom per kg of emulsion is preferably in the range of 10 to 100 g, more preferably 20 to 80 g. It is preferred that a value suitable for rapid addition of the silver iodide fine grain emulsion be selected for the gelatin amount and/or silver quantity.

Although the silver iodide fine grain emulsion is generally dissolved prior to the addition, it is requisite that the agitating efficiency of the system be satisfactorily high at the time of the addition. The agitation rotating speed is preferably set higher than usual. The addition of an antifoaming agent is effective in preventing the foaming during the agitation. Specifically, use is made of antifoaming agents set forth in, for example, Examples of U.S. Pat. No. 5,275,929.

As a further preferred method of effecting lamination with the layer of high iodide content, there can be mentioned the formation of a silver halide phase containing silver iodide while rapidly forming iodide ions with the use of iodide ion-releasing agents described in U.S. Pat. No. 5,496,694, in place of the conventional iodide ion supply method (method of adding free iodide ions).

The iodide ion-releasing agent reacts with an iodide ion release-controlling agent (base and/or nucleophilic agent) to thereby release iodide ions. The nucleophilic agent used in that reaction can preferably be any of the following chemical species. The chemical species include, for example, hydroxide ions, sulfite ions, hydroxylamine, thiosulfate ions, metabisulfite ions, hydroxamic acids, oximes, dihydroxybenzenes, mercaptans, sulfinates, carboxylates, ammonia, amines, alcohols, ureas, thioureas, phenols, hydrazines, hydrazides, semicarbazides, phosphines and sulfides.

The releasing speed and timing of iodide ions can be controlled by controlling the concentrations of base and nucleophilic agent, the addition method thereof and the temperature of reaction mixture. A hydroxide of an alkali metal such as sodium or potassium can preferably be used as the base.

The concentration of each of the iodide ion-releasing agent and iodide ion release-controlling agent which are used to rapidly generate iodide ions is preferably in the range of $1\times10^{-7}$ to 20 M, more referably $1\times10^{-5}$ to 10 M, yet more preferably $1\times10^{-4}$ to 5 M, and most preferably $1\times10^{-3}$ to 2 M.

When the concentration exceeds 20 M, the addition amount of large-molecular-weight iodide ion-releasing agent and iodide ion release-controlling agent is unfavorably too large as compared with the capacity of the grain forming vessel.

On the other hand, when the concentration is lower than $1\times10^{-7}$ M, the iodide ion-releasing reaction rate is unfavorably reduced to such an extent that rapid release of iodide ions becomes difficult.

The reaction temperature is preferably in the range of 30 to 80° C., more preferably 30 to 75° C., and most preferably 30 to 60° C.

When the reaction temperature is higher than 80° C., the iodide ion-releasing reaction rate generally becomes extremely high. On the other hand, when the reaction temperature is lower than 30° C., the iodide ion-releasing reaction rate generally becomes extremely low. Thus, in both the cases, the use conditions are unfavorably limited.

When the base is used in the release of iodide ions, use may be made of changing of the liquid pH. In this instance, the pH for controlling the releasing rate and timing of iodide ions is preferably in the range of 2 to 12, more preferably 3 to 11, and most preferably 5 to 10. The optimum pH after controlling is in the range of 7.5 to 10.0. Even under neutral conditions of pH 7, hydroxide ions defined by the ionic product of water function as a controlling agent.

Furthermore, the nucleophilic agent and the base can be used in combination. In this instance as well, the pH may be controlled so as to fall within the above range to thereby control the releasing rate and timing of iodide ions.

When iodine atoms are released in the form of iodide ions from the iodide ion-releasing agent, all the iodine atoms may be released, or some thereof may remain unreleased without being split.

It is advantageous to use gelatin as a protective colloid for use in the preparation of emulsions of the present invention or as a binder for other hydrophilic colloid layers. However, another hydrophilic colloid can also be used.

Examples of the hydrophilic colloid are protein such as a gelatin derivative, a graft polymer of gelatin and another high polymer, albumin, and casein; sugar derivatives such as cellulose derivatives such as hydroxyethylcellulose, carboxymethylcellulose, and cellulose sulfates, and soda alginate and a starch derivative; and a variety of synthetic hydrophilic high polymers such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinyl pyrazole.

Examples of gelatin are lime-processed gelatin, oxidated gelatin, and enzyme-processed gelatin described in Bull. Soc. Sci. Photo. Japan. No. 16, p. 30 (1966). In addition, a hydrolyzed product or an enzyme-decomposed product of gelatin can also be used.

It is preferable to wash with water an emulsion of the present invention to desalt, and disperse into a newly prepared protective colloid. Although the temperature of washing can be selected in accordance with the intended use, it is preferably 5° C. to 50° C. Although the pH of washing can also be selected in accordance with the intended use, it is preferably 2 to 10, and more preferably, 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

In the preparation of an emulsion of the present invention, it is preferable to make salt of metal ion exist during grain formation, desalting, or chemical sensitization, or before coating in accordance with the intended use. The metal ion salt is preferably added during grain formation when doped into grains, and after grain formation and before completion of chemical sensitization when used to modify the grain surface or used as a chemical sensitizer. The salt can be doped in any of an overall grain, or only the core or the shell, of a grain. Examples of the metal are Mg, Ca, Sr, Ba, Al, Sc, Y, La, Cr, Mn, Fe, Co, Ni, Cu, Zn, Ga, Ru, Rh, Pd, Re, Os, Ir, Pt, Au, Cd, Hg, Tl, In, Sn, Pb, and Bi. These metals can be added as long as they are in the form of salt that can be dissolved during grain formation, such as ammonium salt, acetate, nitrate, sulfate, phosphate, hydroacid salt, 6-coordinated complex salt, or 4-coordinated complex salt. Examples are $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_6]$, $K_3IrCl_6$, $(NH_4)_3RhCl_6$, and $K_4Ru(CN)_6$. The ligand of a coordination compound can be selected from halo, aquo, cyano, cyanate, thiocyanate, nitrosyl, thionitrosyl, oxo, and carbonyl. These metal compounds can be used either singly or in the form of a combination of two or more types of them.

The metal compounds are preferably dissolved in an appropriate solvent, such as methanol or acetone, and added in the form of a solution. To stabilize the solution, an aqueous hydrogen halogenide solution (e.g., HCl and HBr) or an alkali halide (e.g., KCl, NaCl, KBr, and NaBr) can be added. It is also possible to add acid or alkali if necessary. The metal compounds can be added to a reactor vessel either before or during grain formation. Alternatively, the metal compounds can be added to a water-soluble silver salt (e.g., $AgNO_3$) or an aqueous alkali halide solution (e.g., NaCl, KBr, and KI) and added in the form of a solution continuously during formation of silver halide grains. Furthermore, a solution of the metal compounds can be prepared independently of a water-soluble salt or an alkali halide and added continuously at a proper timing during grain formation. It is also possible to combine several different addition methods.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

In the formation of silver halide grains of the present invention, at least one of chalcogen sensitization including sulfur sensitization and selenium sensitization, and noble metal sensitization including gold sensitization and palladium sensitization, and reduction sensitization can be performed at any point during the process of manufacturing a silver halide emulsion. The use of two or more different sensitizing methods is preferable. Several different types of emulsions can be prepared by changing the timing at which the chemical sensitization is performed. The emulsion types are classified into: a type in which a chemical sensitization nucleus is embedded inside a grain, a type in which it is embedded in a shallow position from the surface of a grain, and a type in which it is formed on the surface of a grain. In emulsions of the present invention, the position of a chemical sensitization mucleus can be selected in accordance with the intended use. However, it is preferable to form at least one type of a chemical sensitization nucleus in the vicinity of the surface.

One chemical sensitization which can be preferably performed in the present invention is chalcogen sensitization, noble metal sensitization, or a combination of these. The sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at pAg 5 to 10, pH 5 to 8, and a temperature of 30° C. to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent 1,315,755. In the noble metal sensitization, salts of noble metals, such as gold, platinum, palladium, and iridium, can be used. In particular, gold sensitization, palladium sensitization, or a combination of the both is preferred. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, e.g., a chlorine, bromine, or iodine atom.

More specifically, the palladium compound is preferably $K_2PdCl_4$, $(NH_4)_2pdcl_6$, $Na_2PdCl_4$, $(NH_4)_2PdCl_4$, $Li_2PdCl_4$, $Na_2PdCl_6$, or $K_2PdBr_4$. It is preferable that the gold compound and the palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid modifier are described in U.S. Pat. Nos. 2,131,038, 3,411,914, and 3,554,757, JP-A-58-126526, and G. F. Duffin, Photographic Emulsion Chemistry, pages 138 to 143.

It is preferable to also perform gold sensitization for emulsions of the present invention. An amount of a gold sensitizer is preferably $1\times10^{-4}$ to $1\times10^{-7}$ mol, and more preferably, $1\times10^{-5}$ to $5\times10^{-7}$ mol per mol of a silver halide. A preferable amount of a palladium compound is $1\times10^{-3}$ to $5\times10^{-7}$ mol per mol of a silver halide. A preferable amount of a thiocyan compound or a selenocyan compound is $5\times10^{-2}$ to $1\times10^{-6}$ mol per mol of a silver halide.

An amount of a sulfur sensitizer with respect to silver halide grains of the present invention is preferably $1\times10^{-4}$ to $1\times10^{-7}$ mol, and more preferably, $1\times10^{-5}$ to $5\times10^{-7}$ mol per mol of a silver halide.

Selenium sensitization is a preferable sensitizing method for emulsions of the present invention. Known labile selenium compounds are used in the selenium sensitization. Practical examples of the selenium compound are colloidal metal selenium, selenoureas (e.g., N,N-dimethylselenourea and N,N-diethylselenourea), selenoketones, and selenoamides. In some cases, it is preferable to perform the selenium sensitization in combination with one or both of the sulfur sensitization and the noble metal sensitization.

It is preferable to perform reduction sensitization during grain formation, after grain formation but before chemical sensitization, or during chemical sensitization of the silver halide emulsion.

Reduction sensitization performed in the present invention can be selected from a method of adding reduction sensitizers to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. It is also possible to combine two or more of these methods.

The method of adding reduction sensitizers is preferred in that the level of reduction sensitization can be finely adjusted.

Known examples of the reduction sensitizer are stannous chloride, ascorbic acid and its derivatives, amines and polyamines, hydrazine derivatives, formamidinesulfinic acid, a silane compound, and a borane compound. In reduction sensitization of the present invention, it is possible to selectively use these reduction sensitizers or to use two or more types of compounds together. Preferable compounds as the reduction sensitizer are stannous chloride, thiourea dioxide, dimethylamineborane, and ascorbic acid and its derivatives. Although the addition amount of reduction sensitizers must be so selected as to meet the emulsion manufacturing conditions, a proper amount is $10^{-7}$ to $10^{-3}$ mol per mol of a silver halide.

The reduction sensitizer is, for example, added during grain formation by dissolving thereof to water, or organic solvents such as alcohols, glycols, ketones, esters, and amides. The reduction sensitizer can previously added to a reaction vessel, but it is preferable to add the reduction sensitize at a proper timing during grain growth. It is also possible to previously add the reduction sensitizer to a solution of a water-soluble silver salt or of an alkaline halide, thereby to precipitate silver halide grains using the solutions.

It is also preferable to add a solution of the reduction sensitizer at several times separately during the grain growth or add the solution for a consecutive long period.

It is preferable to use an oxidizer for silver during the process of manufacturing emulsions of the present invention. An oxidizer for silver means a compound having an effect of converting metal silver into silver ion. A particularly effective compound is the one that converts very fine silver grains, as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. An oxidizer for silver can be either an inorganic or organic substance. Examples of the inorganic oxidizer are ozone, hydrogen peroxide and its adduct (e.g., $NaBO_2.H_2O_2.3H_2O$, $2NaCO_3.3H_2O_2$, $Na_4P_2O_7.2H_2O_2$, and $2Na_2SO_4.H_2O_2.2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4].3H_2O$, $4K_2SO_4.Ti(O_2)OH.SO_4.2H_2O$, and $Na_3[VO(O_2)(C_2H_4)_2.6H_2O]$, permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate.

Examples of the organic oxidizer are quinones such as p-quinone, an organic peroxide such as peracetic acid and perbenzoic acid, and a compound for releasing active halogen (e.g., N-bromosuccinimide, chloramine T, and chloramine B).

Preferable oxidizers of the present invention are ozone, hydrogen peroxide and its adduct, a halogen element, an inorganic oxidizer of thiosulfonate, and an organic oxidizer of quinones. The combined use of the aforementioned reduction sensitizer and the oxidizer to silver is a preferable embodiment. The method of adding the oxidizer can be selected from the method of using the oxidizer followed by performing reduction sensitization, the vice versa thereof, or the method of making both of the oxidizer and the reduction sensitizer present at the same time. These methods can be used by selecting a step of grain formation or a chemical sensitization.

Photographic emulsions of the present invention can contain various compounds in order to prevent fog during the manufacturing process, storage, or photographic processing of a sensitive material containing the emulsion, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; azaindenes, such as triazaindenes, tetrazaindenes (particularly 4-hydroxy-substituted(1,3,3a,7) tetrazaindenes), and pentazaindenes.

For example, compounds described in U.S. Pat. Nos. 3,954,474 and 3,982,947 and Jpn. Pat. Appln. KOKOKU Publication No. (hereinafter referred to as JP-B-) 52-28660 can be used. One preferable compound is described in JP-A-63-212932. Antifoggants and stabilizers can be added at any of several different timings, such as before, during, and after grain formation, during washing with water, during dispersion after the washing, before, during, and after chemical sensitization, and before coating, in accordance with the intended application. The antifoggants and the stabilizers can be added during preparation of the emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The photographic emulsion of the present invention is preferably subjected to a spectral sensitization with at least one methine dye or the like, from the viewpoint that the effects desired in the present invention can be exerted. Examples of usable dyes include cyanine dyes, merocyanine dyes, composite cyanine dyes, composite merocyanine dyes, holopolar cyanine dyes, hemicyanine dyes, styryl dyes and hemioxonol dyes. Particularly useful dyes are those belonging to cyanine dyes, merocyanine dyes and composite merocyanine dyes. Any of nuclei commonly used in cyanine dyes as basic heterocyclic nuclei can be applied to these dyes. Examples of such applicable nuclei include a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus and a pyridine nucleus; nuclei comprising these nuclei fused with alicyclic hydrocarbon rings; and nuclei comprising these nuclei fused with aromatic hydrocarbon rings, such as an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus and a quinoline nucleus. These nuclei may have at least one substituent on carbon atoms thereof.

Any of 5 or 6-membered heterocyclic nuclei such as a pyrazolin-5-one nucleus, a thiohydantoin nucleus, a 2-thioxazolidine-2,4-dione nucleus, a thiazolidine-2,4-dione nucleus, a rhodanine nucleus and a thiobarbituric acid nucleus can be applied as a nucleus having a ketomethylene structure to the merocyanine dye or composite merocyanine dye.

These spectral sensitizing dyes may be used either individually or in combination. The spectral sensitizing dyes are often used in combination for the purpose of attaining supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, and GB 1,344,281 and 1,507,803, JP-B's-43-4936 and 53-12375 and JP-A's-52-110618 and 52-109925.

The emulsion of the present invention may be doped with a dye which itself exerts no spectral sensitizing effect or a substance which absorbs substantially none of visible radiation and exhibits supersensitization, together with the above spectral sensitizing dye.

The emulsion may be doped with the spectral sensitizing dye at any stage of the process for preparing the emulsion which is known as being useful. Although the doping is most usually conducted at a stage between the completion of the chemical sensitization and before the coating, the spectral sensitizing dye can be added simultaneously with the chemical sensitizer to thereby simultaneously effect the spectral sensitization and the chemical sensitization as described in U.S. Pat. Nos. 3,628,969 and 4,225,666. Alternatively, the spectral sensitization can be conducted prior to the chemical sensitization as described in JP-A-58-113928, and also, the spectral sensitizing dye can be added prior to the completion of silver halide grain precipitation to thereby initiate the spectral sensitization. Further, the above compound can be divided prior to addition, that is, part of the compound can be added prior to the chemical sensitization with the rest of the compound added after the chemical sensitization as taught in U.S. Pat. No. 4,225,666. Still further, the spectral sensitizing dye can be added at any stage during the formation of silver halide grains, such as the method disclosed in U.S. Pat. No. 4,183,756 and other methods.

The addition amount of the spectral sensitizing dye can range from $4\times10^{-6}$ to $8\times10^{-3}$ mol per mol of the silver halide.

In the lightsensitive material of the present invention prepared by using the emulsion of the invention, it is only required that at least one silver halide emulsion layer be formed on a support. A typical example is a silver halide photographic lightsensitive material having, on its support, at least one lightsensitive layer constituted by a plurality of silver halide emulsion layers which are sensitive to essentially the same color but have different sensitivities. This lightsensitive layer includes a unit lightsensitive layer which is sensitive to one of blue light, green light and red light. In a multilayered silver halide color photographic lightsensitive material, these unit lightsensitive layers are generally arranged in the order of red-, green- and blue-sensitive layers from a support. However, according to the intended use, this arrangement order may be reversed, or lightsensitive layers sensitive to the same color can sandwich another lightsensitive layer sensitive to a different color. Non lightsensitive layers can be formed between the silver halide lightsensitive layers and as the uppermost layer and the lowermost layer. These intermediate layers may contain, e.g., couplers to be described later, DIR compounds and color-mixing inhibitors. As for a plurality of silver halide emulsion layers constituting respective unit lightsensitive layer, a two-layered structure of high- and low-speed emulsion layers can be preferably used in this order so as to the speed becomes lower toward the support as described in DE (German Patent) 1,121,470 or GB 923,045, the disclosures of which are incorporated herein by reference. Also, as described in JP-A's-57-112751, 62-200350, 62-206541 and 62-206543, the disclosures of which are incorporated herein by reference, layers can be arranged such that a low-speed emulsion layer is formed farther from a support and a high-speed layer is formed closer to the support.

More specifically, layers can be arranged from the farthest side from a support in the order of low-speed blue-sensitive layer (BL)/high-speed blue-sensitive layer (BH)/high-speed green-sensitive layer (GH)/low-speed green-sensitive layer (GL)/high-speed red-sensitive layer (RH)/low-speed red-sensitive layer (RL), the order of BH/BL/GL/GH/RH/RL or the order of BH/BL/GH/GL/RL/RH.

In addition, as described in JP-B-55-34932, the disclosure of which is incorporated herein by reference, layers can be arranged from the farthest side from a support in the order of blue-sensitive layer/GH/RH/GL/RL. Furthermore, as described in JP-A's-56-25738 and 62-63936, the disclosures of which are incorporated herein by reference, layers can be arranged from the farthest side from a support in the order of blue-sensitive layer/GL/RL/GH/RH.

As described in JP-B-49-15495, the disclosure of which is incorporated herein by reference, three layers can be arranged such that a silver halide emulsion layer having the highest sensitivity is arranged as an upper layer, a silver halide emulsion layer having sensitivity lower than that of the upper layer is arranged as an interlayer, and a silver halide emulsion layer having sensitivity lower than that of the interlayer is arranged as a lower layer; i.e., three layers having different sensitivities can be arranged such that the sensitivity is sequentially decreased toward the support. Even when a layer structure is constituted by three layers having different sensitivities, these layers can be arranged in the order of medium-speed emulsion layer/high-speed emulsion layer/low-speed emulsion layer from the farthest side from a support in a layer sensitive to one color as described in JP-A-59-202464, the disclosure of which is incorporated herein by reference.

In addition, the order of high-speed emulsion layer/low-speed emulsion layer/medium-speed emulsion layer or low-speed emulsion layer/medium-speed emulsion layer/high-speed emulsion layer can be adopted. Furthermore, the arrangement can be changed as described above even when four or more layers are formed.

To improve the color reproducibility, as described in U.S. Pat. Nos. 4,663,271, 4,705,744, and 4,707,436, and JP-A's-62-160448, and 63-89850, the disclosures of which are incorporated herein by reference, a donor layer (CL) with an interlayer effect, which has a different spectral sensitivity distribution from that of a main sensitive layer such as BL, GL, or RL, is preferably formed adjacent to, or close to, this main sensitive layer.

A silver halide used in the present invention is silver iodobromide, silver iodochloride, or silver bromochloroiodide containing about 30 mol % or less of silver iodide. A particularly preferable silver halide is silver iodobromide or silver bromochloroiodide containing about 2 to about 10 mol % of silver iodide.

Silver halide grains contained in a photographic emulsion can have regular crystals such as cubic, octahedral, or tetradecahedral crystals, irregular crystals such as spherical or tabular crystals, crystals having crystal defects such as twin planes, or composite shapes thereof.

A silver halide can consist of fine grains having a grain size of about 0.2 $\mu$m or less or large grains having a projected area diameter of about 10 $\mu$m, and an emulsion can be either a polydisperse or monodisperse emulsion.

A silver halide photographic emulsion which can be used in the present invention can be prepared by methods described in, e.g., "I. Emulsion preparation and types," Research Disclosure (RD) No. 17643 (December, 1978), pp. 22 and 23, and RD No. 18716 (November, 1979), page 648, and RD No. 307105 (November, 1989), pp. 863 to 865; P. Glafkides, "Chemie et Phisique Photographique", Paul Montel, 1967; G. F. Duffin, "Photographic Emulsion Chemistry", Focal Press, 1966; and V. L. Zelikman et al., "Making and Coating Photographic Emulsion", Focal Press, 1964.

Monodisperse emulsions described in, e.g., U.S. Pat. Nos. 3,574,628 and 3,655,394, and GB1,413,748 are also preferable.

Tabular grains having an aspect ratio of about 3 or more can also be used in the present invention. Tabular grains can be easily prepared by methods described in Gutoff, "Photographic Science and Engineering", Vol. 14, pp. 248 to 257 (1970); and U.S. Pat. Nos. 4,434,226, 4,414,310, 4,433,048, and 4,439,520, and GB2,112,157.

A crystal structure can be uniform, can have different halogen compositions in the interior and the surface layer thereof, or can be a layered structure. Alternatively, a silver halide having a different composition can be bonded by an epitaxial junction or a compound except for a silver halide such as silver rhodanide or lead oxide can be bonded. A mixture of grains having various types of crystal shapes can also be used.

The above emulsion can be any of a surface latent image type emulsion which mainly forms a latent image on the surface of a grain, an internal latent image type emulsion which forms a latent image in the interior of a grain, and another type of emulsion which has latent images on the surface and in the interior of a grain. However, the emulsion must be a negative type emulsion. The internal latent image type emulsion can be a core/shell internal latent image type emulsion described in JP-A-63-264740, the disclosure of which is incorporated herein by reference. A method of preparing this core/shell internal latent image type emulsion is described in JP-A-59-133542, the disclosure of which is incorporated herein by reference. Although the thickness of a shell of this emulsion depends on, e.g., development conditions, it is preferably 3 to 40 nm, and most preferably, 5 to 20 nm.

A silver halide emulsion is normally subjected to physical ripening, chemical ripening, and spectral sensitization steps before it is used. Additives for use in these steps are described in RD Nos. 17643, 18716, and 307105, and they are summarized in a table to be presented later.

In a lightsensitive material of the present invention, it is possible to mix, in a single layer, two or more types of emulsions different in at least one of characteristics of a photosensitive silver halide emulsion, i.e., a grain size, grain size distribution, halogen composition, grain shape, and sensitivity.

It is also possible to preferably use surface-fogged silver halide grains described in U.S. Pat. No. 4,082,553, internally fogged silver halide grains described in U.S. Pat. No. 4,626,498 and JP-A-59-214852, and colloidal silver, in sensitive silver halide emulsion layers and/or substantially non-sensitive hydrophilic colloid layers. The internally fogged or surface-fogged silver halide grain means a silver halide grain which can be developed uniformly (non-imagewise) regardless of whether the location is a non-exposed portion or an exposed portion of the photosensitive material. A method of preparing the internally fogged or surface-fogged silver halide grain is described in U.S. Pat. No. 4,626,498 and JP-A-59-214852. A silver halide which forms the core of an internally fogged core/shell type silver halide grain can have a different halogen composition. As the internally fogged or surface-fogged silver halide, any of silver chloride, silver chlorobromide, silver bromoiodide, and silver bromochloroiodide can be used. The average grain size of these fogged silver halide grains is preferably 0.01 to 0.75 $\mu$m, and most preferably, 0.05 to 0.6 $\mu$m. The grain shape can be a regular grain shape. Although the emulsion can be a polydisperse emulsion, it is preferably a monodisperse emulsion (in which at least 95% in weight or number of grains of silver halide grains have grain sizes falling within the range of ±40% of the average grain size).

In the present invention, it is preferable to use a non-sensitive fine grain silver halide. The non-sensitive fine grain silver halide preferably consists of silver halide grains which are not exposed during imagewise exposure for obtaining a dye image and are not essentially developed during development. These silver halide grains are preferably not fogged in advance. In the fine grain silver halide, the content of silver bromide is 0 to 100 mol %, and silver chloride and/or silver iodide can be added if necessary. The fine grain silver halide preferably contains 0.5 to 10 mol % of silver iodide. The average grain size (the average value of equivalent circle diameters of projected areas) of the fine grain silver halide is preferably 0.01 to 0.5 $\mu$m, and more preferably, 0.02 to 0.2 $\mu$m.

The fine grain silver halide can be prepared following the same procedures as for a conventional light-sensitive silver halide. The surface of each silver halide grain need not be optically sensitized nor spectrally sensitized. However, before the silver halide grains are added to a coating solution, it is preferable to add a well-known stabilizer such as a triazole-based compound, azaindene-based compound, benzothiazolium-based compound, mercapto-based compound, or zinc compound. Colloidal silver can be added to this fine grain silver halide grain-containing layer.

The silver coating amount of a lightsensitive material of the present invention is preferably 6.0 g/m$^2$ or less, and most preferably, 4.5 g/m$^2$ or less.

Photographic additives usable in the present invention are also described in RD's, the disclosures of which are incorporated herein by reference, and the relevant portions are summarized in the following table.

| | Additives | RD17643 | RD18716 | RD307105 |
|---|---|---|---|---|
| 1. | Chemical sensitizers | page 23 | page 648, right column | page 866 |
| 2. | Sensitivity increasing agents | | do | |
| 3. | Spectral sensitizers, super sensitizers | pages 23–24 | page 648, right column to page 649, right column | pages 866–868 |
| 4. | Brighteners | page 24 | page 647, right column | page 868 |
| 5. | Light absorbents, filter dyes, ultraviolet absorbents | pages 25–26 | page 649, right column to page 650, left column | page 873 |
| 6. | Binders | page 26 | page 651, left column | pages 873–874 |
| 7. | Plasticizers, lubricants | page 27 | page 650, right column | page 876 |
| 8. | Coating aids, surface active agents | pages 26–27 | do | pages 875–876 |
| 9. | Antistatic agents | page 27 | do | pages 876–877 |
| 10. | Matting agents | | | pages 878–879 |

Various dye forming couplers can be used in a lightsensitive material of the present invention, and the following couplers disclosed in the documents, the disclosures of which are incorporated herein by reference, are particularly preferable.

Yellow couplers: couplers represented by formulas (I) and (II) in EP502,424A; couplers (particularly Y-28 on page 18) represented by formulas (1) and (2) in EP513,496A; a coupler represented by formula (I) in claim 1 of EP568,037A; a coupler represented by formula (I) in column 1, lines 45 to 55 of U.S. Pat. No. 5,066,576; a coupler represented by formula (I) in paragraph 0008 of JP-A-4-274425; couplers (particularly D-35 on page 18) described in claim 1 on page 40 of EP498,381A1; couplers (particularly Y-1 (page 17) and Y-54 (page 41)) represented by formula (Y) on page 4 of EP447,969A1; and couplers (particularly II-17 and II-19 (column 17), and II-24 (column 19)) represented by formulas (II) to (IV) in column 7, lines 36 to 58 of U.S. Pat. No. 4,476,219.

Magenta couplers: JP-A-3-39737 (L-57 (page 11, lower right column), L-68 (page 12, lower right column), and L-77 (page 13, lower right column); [A-4]-63 (page 134), and [A-4]-73 and [A-4]-75 (page 139) in EP456,257; M-4 and M-6 (page 26), and M-7 (page 27) in EP486,965; M-45 (page 19) in EP571,959A; (M-1) (page 6) in JP-A-5-204106; and M-22 in paragraph 0237 of JP-A-4-362631.

Cyan couplers: CX-1, CX-3, CX-4, CX-5, CX-11, CX-12, CX-14, and CX-15 (pages 14 to 16) in JP-A-4-204843; C-7 and C-10 (page 35), C-34 and C-35 (page 37), and (I-1) and (I-17) (pages 42 and 43) in JP-A-4-43345; and couplers represented by formulas (Ia) and (Ib) in claim 1 of JP-A-6-67385.

Polymer couplers: P-1 and P-5 (page 11) in JP-A-2-44345.

Couplers for forming a colored dye with a proper diffusibility are preferably those described in U.S. Pat. No. 4,366,237, GB2,125,570, EP96,873B, and DE3,234,533.

Couplers for correcting unnecessary absorption of a colored dye are preferably yellow colored cyan couplers (particularly YC-86 on page 84) represented by formulas (CI), (CII), (CIII), and (CIV) described on page 5 of EP456,257A1; yellow colored magenta couplers ExM-7 (page 202), EX-1 (page 249), and EX-7 (page 251) in EP456,257A1; magenta colored cyan couplers CC-9 (column 8) and CC-13 (column 10) described in U.S. Pat. No. 4,833,069; coupler (2) (column 8) in U.S. Pat. No. 4,837,136; and colorless masking couplers (particularly compound examples on pages 36 to 45) represented by formula (A) in claim 1 of WO92/11575.

Examples of a compound which releases a photographically useful group are as follows. Development inhibitor release compounds: compounds (particularly T-101 (page 30), T-104 (page 31), T-113 (page 36), T-131 (page 45), T-144 (page 51), and T-158 (page 58)) represented by formulas (I), (II), (III), (IV) described on page 11 of EP378,236A1, compounds (particularly D-49 (page 51)) represented by formula (I) described on page 7 of EP436,938A2, compounds (particularly (23) (page 11)) represented by formula (1) in EP568,037A, and compounds (particularly I-(1) on page 29) represented by formulas (I), (II), and (III) described on pages 5 and 6 of EP440,195A2; bleaching accelerator-releasing compounds: compounds (particularly (60) and (61) on page 61) represented by formulas (I) and (I') on page 5 of EP310,125A2, and compounds (particularly (7) (page 7)) represented by formula (I) in claim 1 of JP-A-6-59411; ligand-releasing compounds: compounds (particularly compounds in column 12, lines 21 to 41) represented by LIG-X described in claim 1 of U.S. Pat. No. 4,555,478; leuco dye-releasing compounds: compounds 1 to 6 in columns 3 to 8 of U.S. Pat. No. 4,749,641; fluorescent dye release compounds: compounds (particularly compounds 1 to 11 in columns 7 to 10) represented by COUP-DYE in claim 1 of U.S. Pat. No. 4,774,181; development accelerator or fogging agent-releasing compounds: compounds (particularly (I-22) in column 25) represented by formulas (1), (2), and (3) in column 3 of U.S. Pat. No. 4,656,123, and ExZK-2 on page 75, lines 36 to 38 of EP450,637A2; compounds which release a group which does not function as a dye unless it splits off: compounds (particularly Y-1 to Y-19 in columns 25 to 36) represented by formula (I) in claim 1 of U.S. Pat. No. 4,857,447.

Preferable examples of additives other than couplers are as follows.

Dispersants of an oil-soluble organic compound: P-3, P-5, P-16, P-19, P-25, P-30, P-42, P-49, P-54, P-55, P-66, P-81, P-85, P-86, and P-93 (pages 140 to 144) in JP-A-62-215272; impregnating latexes of an oil-soluble organic compound: latexes described in U.S. Pat. No. 4,199,363; developing agent oxidized form scavengers: compounds (particularly I-(1), I-(2), I-(6), and I-(12) (columns 4 and 5)) represented by formula (I) in column 2, lines 54 to 62 of U.S. Pat. No. 4,978,606, and formulas (particularly a compound 1 (column 3)) in column 2, lines 5 to 10 of U.S. Pat. No. 4,923,787; stain inhibitors: formulas (I) to (III) on page 4, lines 30 to 33, particularly I-47, I-72, III-1, and III-27 (pages 24 to 48) in EP298321A; discoloration inhibitors: A-6, A-7, A-20, A-21, A-23, A-24, A-25, A-26, A-30, A-37, A-40, A-42, A-48, A-63, A-90, A-92, A-94, and A-164 (pages 69 to 118) in EP298321A, II-1 to III-23, particularly III-10 in columns 25 to 38 of U.S. Pat. No. 5,122,444, I-1 to III-4, particularly II-2 on pages 8 to 12 of EP471347A, and A-1 to A-48, particularly A-39 and A-42 in columns 32 to 40 of U.S. Pat. No. 5,139,931; materials which reduce the use amount of a color enhancer or a color amalgamation inhibitor: I-1 to II-15, particularly I-46 on pages 5 to 24 of EP411324A; formalin scavengers: SCV-1 to SCV-28, particularly SCV-8 on pages 24 to 29 of EP477932A; film hardeners: H-1, H-4, H-6, H-8, and H-14 on page 17 of JP-A-1-214845, compounds (H-1 to H-54) represented by formulas (VII) to (XII) in columns 13 to 23 of U.S. Pat. No. 4,618,573, compounds (H-1 to H-76), particularly H-14 represented by formula (6) on page 8, lower right column of JP-A-2-214852, and compounds described in claim 1 of U.S. Pat. No. 3,325,287; development inhibitor precursors: P-24, P-37, and P-39 (pages 6 and 7) in JP-A-62-168139; compounds described in claim 1, particularly 28 and 29 in column 7 of U.S. Pat. No. 5,019,492; antiseptic agents and mildewproofing agents: I-1 to III-43, particularly II-1, II-9, II-10, II-18, and III-25 in columns 3 to 15 of U.S. Pat. No. 4,923,790; stabilizers and antifoggants: I-1 to (14), particularly I-1, I-60, (2), and (13) in columns 6 to 16 of U.S. Pat. No. 4,923,793, and compounds 1 to 65, particularly the compound 36 in columns 25 to 32 of U.S. Pat. No. 4,952,483; chemical sensitizers: triphenylphosphine selenide and a compound 50 in JP-A-5-40324; dyes: a-1 to b-20, particularly a-1, a-12, a-18, a-27, a-35, a-36, and b-5 on pages 15 to 18 and V-1 to V-23, particularly V-1 on pages 27 to 29 of JP-A-3-156450, F-I-1 to F-II-43, particularly F-I-11 and F-II-8 on pages 33 to 55 of EP445627A, III-1 to III-36, particularly III-1 and III-3 on pages 17 to 28 of EP457153A, fine crystal dispersions of Dye-1 to Dye-124 on pages 8 to 26 of WO88/04794, compounds 1 to 22, particularly the compound 1 on pages 6 to 11 of EP319999A, compounds D-1 to D-87 (pages 3 to 28) represented by formulas (1) to (3) in EP519306A, compounds 1 to 22 (columns 3 to 10) represented by formula (I) in U.S. Pat. No. 4,268,622, and compounds (1) to (31) (columns 2 to 9) represented by formula (I) in U.S. Pat. No. 4,923,788; UV absorbents: compounds (18b) to (18r) and 101 to 427 (pages 6 to 9) represented by formula (1) in JP-A-46-3335, compounds (3) to (66) (pages 10 to 44) and compounds HBT-1 to HBT-10 (page 14) represented by formula (III) in EP520938A, and compounds (1) to (31) (columns 2 to 9) represented by formula (1) in EP521823A.

The present invention can be applied to various color lightsensitive materials such as color negative films for general purposes or movies, color reversal films for slides or television, color paper, color positive films, and color reversal paper. The present invention is also suited to film units with lens described in JP-B-2-32615 and Jpn. UM Appln. KOKOKU Publication No. 3-39784.

A support which can be suitably used in the present invention is described in, e.g., RD. No. 17643, page 28, RD. No. 18716, page 647, right column to page 648, left column, and RD. No. 307105, page 879.

In a lightsensitive material of the present invention, the total film thickness of all hydrophilic colloid layers on the side having emulsion layers is preferably 28 μm or less, more preferably, 23 μm or less, most preferably, 18 μm or less, and particularly preferably, 16 μm or less. A film swelling speed $T_{1/2}$ is preferably 30 sec or less, and more preferably, 20 sec or less. $T_{1/2}$ is defined as a time which the film thickness requires to reach ½ of a saturation film thickness which is 90% of a maximum swell film thickness reached when processing is performed by using a color developer at 30° C. for 3 min and 15 sec. A film thickness means the thickness of a film measured under moisture conditioning at a temperature of 25° C. and a relative humidity of 55% (two days). $T_{1/2}$ can be measured by using a swell meter described in Photogr. Sci. Eng., A. Green et al., Vol. 19, No. 2, pp. 124 to 129. $T_{1/2}$ can be adjusted by adding a film hardening agent to gelatin as a binder or changing aging conditions after coating. The swell ratio is preferably 150 to 400%. The swell ratio can be calculated from the maximum swell film thickness under the conditions mentioned above by using (maximum swell film thickness—film thickness)/film thickness.

In a lightsensitive material of the present invention, hydrophilic colloid layers (called back layers) having a total dried film thickness of 2 to 20 μm are preferably formed on the side opposite to the side having emulsion layers. The back layers preferably contain, e.g., the aforementioned light absorbents, filter dyes, ultraviolet absorbents, antistatic agents, film hardeners, binders, plasticizers, lubricants, coating aids, and surfactants. The swell ratio of the back layers is preferably 150 to 500%.

A lightsensitive material according to the present invention can be developed by conventional methods described in RD. No. 17643, pp. 28 and 29, RD. No. 18716, page 651, left to right columns, and RD No. 307105, pp. 880 and 881.

Color negative film processing solutions used in the present invention will be described below.

Compounds described in JP-A-4-121739, page 9, upper right column, line 1 to page 11, lower left column, line 4 can be used in a color developer of the present invention. As a color developing agent used when particularly rapid processing is to be performed, 2-methyl-4-[N-ethyl-N-(2-hydroxyethyl)amino]aniline, 2-methyl-4-[N-ethyl-N-(3-hydroxypropyl)amino]aniline, or 2-methyl-4-[N-ethyl-N-(4-hydroxybutyl)amino]aniline is preferable.

The use amount of any of these color developing agents is preferably 0.01 to 0.08 mol, more preferably, 0.015 to 0.06 mol, and most preferably, 0.02 to 0.05 mol per liter (to be referred to as "L" hereinafter) of a color developer. Also, a replenisher of a color developer preferably contains a color developing agent at a concentration 1.1 to 3 times, particularly 1.3 to 2.5 times the above concentration.

As a preservative of a color developer, hydroxylamine can be extensively used. If higher preservability is necessary, the use of a hydroxylamine derivative having a substituent such as an alkyl group, hydroxylalkyl group, sulfoalkyl group, or carboxyalkyl group is preferable. Examples are N,N-di(sulfoethyl)hydroxylamine, monomethylhydroxylamine, dimethylhydroxylamine, monoethylhydroxylamine, diethylhydroxylamine, and N,N-di(carboxylethyl) hydroxylamine. Of these derivatives, N,N-di(sulfoethyl) hydroxylamine is particularly preferable. Although these derivatives can be used together with hydroxylamine, it is preferable to use one or two types of these derivatives instead of hydroxylamine.

The use amount of a preservative is preferably 0.02 to 0.2 mol, more preferably, 0.03 to 0.15 mol, and most preferably, 0.04 to 0.1 mol per L. As in the case of a color developing agent, a replenisher preferably contains a preservative at a concentration 1.1 to 3 times that of a mother solution (processing tank solution).

A color developer contains sulfite as an agent for preventing an oxide of a color developing agent from changing into tar. The use amount of this sulfite is preferably 0.01 to 0.05 mol, and more preferably, 0.02 to 0.04 mol per L. Sulfite is preferably used at a concentration 1.1 to 3 times the above concentration in a replenisher.

The pH of a color developer is preferably 9.8 to 11.0, and more preferably 10.0 to 10.5. In a replenisher, the pH is preferably set to be higher by 0.1 to 1.0 than these values. To stably maintain this pH, a known buffering agent such as carbonate, phosphate, sulfosalicylate, or borate is used.

The replenishment rate of a color developer is preferably 80 to 1,300 milliliters (to be also referred to as "mL" hereinafter) per $m^2$ of a lightsensitive material. However, the replenishment rate is preferably smaller in order to reduce environmental pollution. For example, the replenishment rate is preferably 80 to 600 mL, and more preferably, 80 to 400 mL.

The bromide ion concentration in the color developer is usually 0.01 to 0.06 mol per L. However, this bromide ion concentration is preferably set at 0.015 to 0.03 mol per L in order to suppress fog and improve discrimination and graininess while maintaining sensitivity. To set the bromide ion concentration in this range, it is only necessary to add bromide ions calculated by the following equation to a replenisher. If C takes a negative value, however, no bromide ions are preferably added to a replenisher.

$$C=A-W/V$$

where

C: a bromide ion concentration (mol/L) in a color developer replenisher

A: a target bromide ion concentration (mol/L) in a color developer

W: an amount (mol) of bromide ions dissolving into a color developer from 1 $m^2$ of a lightsensitive material when the sensitive material is color-developed V: a replenishment rate (L) of a color developer replenisher for 1 $m^2$ of a lightsensitive material As a method of increasing the sensitivity when the replenishment rate is decreased or high bromide ion concentration is set, it is preferable to use a development accelerator such as pyrazolidones represented by 1-phenyl-3-pyrazolidone and 1-phenyl-2-methyl-2-hydroxylmethyl-3-pyrazolidone, or a thioether compound represented by 3,6-dithia-1,8-octandiol.

Compounds and processing conditions described in JP-A-4-125558, page 4, lower left column, line 16 to page 7, lower left column, line 6 can be applied to a processing solution having bleaching capacity in the present invention.

This bleaching agent preferably has an oxidation-reduction potential of 150 mV or more. Preferable practical examples of the bleaching agent are described in JP-A's-5-72694 and 5-173312. In particular, 1,3-diaminopropane tetraacetic acid and ferric complex salt of a compound as practical example 1 in JP-A-5-173312, page 7 are preferable.

To improve the biodegradability of a bleaching agent, it is preferable to use compound ferric complex salts described in JP-A's-4-251845, and 4-268552, EP588,289, EP591,934, and JP-A-6-208213 as the bleaching agent. The concentration of any of these bleaching agents is preferably 0.05 to 0.3 mol per L of a solution having bleaching capacity. To reduce the amount of waste to the environment, the concentration is preferably designed to be 0.1 to 0.15 mol per L of the solution having bleaching capacity. When the solution having bleaching capacity is a bleaching solution, preferably 0.2 to 1 mol, and more preferably, 0.3 to 0.8 mol of a bromide is added per L.

A replenisher of the solution having bleaching capacity basically contains components at concentrations calculated by the following equation. This makes it possible to maintain the concentrations in a mother solution constant.

$$CR=CT\times(V1+V2)/V1+CP$$

where

CR: concentrations of components in a replenisher

CT: concentrations of components in a mother solution (processing tank solution)

CP: concentrations of components consumed during processing

V1: a replenishment rate (mL) of a replenisher having bleaching capacity per $m^2$ of a lightsensitive material V2: an amount (mL) carried over from a pre-bath per $m^2$ of a lightsensitive material Additionally, a bleaching solution preferably contains a pH buffering agent, and more preferably contains dicarboxylic acid with little odor such as succinic acid, maleic acid, malonic acid, glutaric acid, adipic acid and the like. Also, the use of known bleaching accelerators described in JP-A-53-95630, RD No. 17129, and U.S. Pat. No. 3,893,858 is preferable.

It is preferable to replenish 50 to 1,000 mL of a bleaching replenisher to a bleaching solution per $m^2$ of a lightsensitive material. The replenishment rate is more preferably 80 to 500 mL, and most preferably, 100 to 300 mL. Aeration of a bleaching solution is also preferable.

Compounds and processing conditions described in JP-A-4-125558, page 7, lower left column, line 10 to page 8, lower right column, line 19 can be applied to a processing solution with fixing capacity.

To improve the fixing rate and preservability, compounds represented by formulas (I) and (II) described in JP-A-6-301169 are preferably added singly or together to a processing solution with fixing capacity. To improve the preservability, the use of sulfinic acid such as p-toluenesulfinate described in JP-A-1-224762 is also preferable.

To improve the desilvering characteristics, ammonium is preferably used as cation in a solution with bleaching capacity or a solution with fixing capacity. However, the amount of ammonium is preferably reduced, or zero, to reduce environmental pollution.

In the bleaching, bleach-fixing, and fixing steps, it is particularly preferable to perform jet stirring described in JP-A-1-309059.

The replenishment rate of a replenisher in the bleach-fixing or fixing step is preferably 100 to 1,000 mL, more preferably, 150 to 700 mL, and most preferably, 200 to 600 mL per $m^2$ of a lightsensitive material.

In the bleach-fixing or fixing step, an appropriate silver collecting apparatus is preferably installed either in-line or off-line to collect silver. When the apparatus is installed in-line, processing can be performed while the silver concentration in a solution is reduced, so the replenishment rate can be reduced. It is also preferable to install the apparatus off-line to collect silver and reuse the residual solution as a replenisher.

The bleach-fixing or fixing step can be performed by using a plurality of processing tanks, and these tanks are preferably cascaded to form a multistage counterflow system. To balance the size of a processor, a two-tank cascade system is generally efficient. The processing time ratio of the front tank to the rear tank is preferably 0.5:1 to 1:0.5, and more preferably, 0.8:1 to 1:0.8.

In a bleach-fixing or fixing solution, the presence of free chelating agents which are not metal complexes is preferable to improve the preservability. AS these chelating agents, the use of the biodegradable chelating agents previously described in connection to a bleaching solution is preferable.

Contents described in aforementioned JP-A-4-125558, page 12, lower right column, line 6 to page 13, lower right column, line 16 can be preferably applied to the washing and stabilization steps. To improve the safety of the work environment, it is preferable to use azolylmethylamines described in EP504,609 and EP519,190 or N-methylolazoles described in JP-A-4-362943 instead of formaldehyde in a stabilizer and to make a magenta coupler divalent to form a solution of surfactant containing no image stabilizing agent such as formaldehyde.

To reduce adhesion of dust to a magnetic recording layer formed on a lightsensitive material, a stabilizing liquid described in JP-A-6-289559 can be preferably used.

The replenishment rate of washing water and a stabilizing liquid is preferably 80 to 1,000 mL, more preferably, 100 to 500 mL, and most preferably, 150 to 300 mL per $m^2$ of a lightsensitive material in order to maintain the washing and stabilization functions and at the same time reduce the waste liquors for environmental protection. In processing performed with this replenishment rate, it is preferable to prevent the propagation of bacteria and mildew by using known mildewproofing agents such as thiabendazole, 1,2-benzoisothiazoline-3-one, and 5-chloro-2-methylisothiazoline-3-one, antibiotics such as gentamicin, and water deionized by an ion exchange resin or the like. It is more effective to use deionized water together with a mildewproofing agent or an antibiotic.

The replenishment rate of a solution in a washing water tank or stabilizer tank is preferably reduced by performing reverse permeable membrane processing described in JP-A's-3-46652, 3-53246, 3-55542, 3-121448, and 3-126030. A reverse permeable membrane used in this processing is preferably a low-pressure reverse permeable membrane.

In the processing of the present invention, it is particularly preferable to perform processing solution evaporation correction disclosed in Journal of Technical Disclosure No. 94-4992. In particular, a method of performing correction on the basis of (formula-1) on page 2 by using temperature and humidity information of an environment in which a processor is installed is preferable. Water for use in this evaporation correction is preferably taken from the washing water replenishment tank. If this is the case, deionized water is preferably used as the washing replenishing water.

Processing agents described in aforementioned Journal of Technical Disclosure No. 94-4992, page 3, right column, line 15 to page 4, left column, line 32 are preferably used in the present invention. As a processor for these processing agents, a film processor described on page 3, right column, lines 22 to 28 is preferable.

Practical examples of processing agents, automatic processors, and evaporation correction methods suited to practicing the present invention are described in the same Journal of Technical Disclosure No. 94-4992, page 5, right column, line 11 to page 7, right column, last line.

Processing agents used in the present invention can be supplied in any form: a liquid agent having the concentration of a solution to be used, concentrated liquid agent, granules, powder, tablets, paste, and emulsion. Examples of such processing agents are a liquid agent contained in a low-oxygen permeable vessel disclosed in JP-A-63-17453, vacuum-packed powders and granules disclosed in JP-A's-4-19655 and 4-230748, granules containing a water-soluble polymer disclosed in JP-A-4-221951, tablets disclosed in JP-A's-51-61837 and 6-102628, and a paste disclosed in PCT KOHYO Publication No. 57-500485. Although any of these processing agents can be preferably used, the use of a liquid adjusted to have the concentration of a solution to be used is preferable for the sake of convenience in use.

As a vessel for containing these processing agents, polyethylene, polypropylene, polyvinylchloride, polyethyleneterephthalate, and nylon are used singly or as a composite material. These materials are selected in accordance with the level of necessary oxygen permeability. For a readily oxidizable solution such as a color developer, a low-oxygen permeable material is preferable. More specifically, polyethyleneterephthalate or a composite material of polyethylene and nylon is preferable. A vessel made of any of these materials preferably has a thickness of 500 to 1,500 $\mu$m and an oxygen permeability of 20 mL/m$^2$·24 hrs·atm or less.

Color reversal film processing solutions used in the present invention will be described below.

Processing for a color reversal film is described in detail in Aztech Ltd., Known Technology No. 6 (Apr. 1, 1991), page 1, line 5 to page 10, line 5 and page 15, line 8 to page 24, line 2, and any of the contents can be preferably applied.

In this color reversal film processing, an image stabilizing agent is contained in a control bath or a final bath. Preferable examples of this image stabilizing agent are formalin, sodium formaldehyde-bisulfite, and N-methylolazole. Sodium formaldehyde-bisulfite or N-methylolazole is preferable in terms of work environment, and N-methyloltriazole is particularly preferable as N-methylolazole. The contents pertaining to a color developer, bleaching solution, fixing solution, and washing water described in the color negative film processing can be preferably applied to the color reversal film processing.

Preferable examples of color reversal film processing agents containing the above contents are an E-6 processing agent manufactured by Eastman Kodak Co. and a CR-56 processing agent manufactured by Fuji Photo Film Co., Ltd.

The color photosensitive material of the present invention is also suitably used as a negative film for an advanced photo system (to be referred to as an APS hereinafter). Examples are NEXIA A, NEXIA F, and NEXIA H (ISO 200, 100, and 400, respectively) manufactured by Fuji Photo Film Co., Ltd. (to be referred to as Fuji Film hereinafter). These films are so processed as to have an APS format and set in an exclusive cartridge. These APS cartridge films are loaded into APS cameras such as the Fuji Film EPION Series represented by the EPION 300Z.

The color photosensitive film of the present invention is also suited as a film with lens such as Fuji Film FUJICOLOR UTSURUNDESU (Quick Snap) SUPER SLIM.

A photographed film is printed through the following steps in a miniature laboratory system.

(1) Reception (an exposed cartridge film is received from a customer).

(2) Detaching step (the film is transferred from the cartridge to an intermediate cartridge for development).

(3) Film development.

(4) Reattaching step (the developed negative film is returned to the original cartridge).

(5) Printing (prints of three types C, H, and P and an index print are continuously automatically printed on color paper [preferably Fuji Film SUPER FA8]).

(6) Collation and shipment (the cartridge and the index print are collated by an ID number and shipped together with the prints).

As these systems, the Fuji Film MINILABO CHAMPION SUPER FA-298, FA-278, FA-258, FA-238 are preferable. Examples of a film processor are the FP922AL, FP562B, FP562BL, FP362B, and FP3622BL, and a recommended processing chemical is the FUJICOLOR JUST-IT CN-16L. Examples of a printer processor are the PP3008AR, PP3008A, PP1828AR, PP1828A, PP1258AR, PP1258A, PP728AR, and PP728A, and a recommended processing chemical is the FUJICOLOR JUST-IT CP-47L. A detacher used in the detaching step and a reattacher used in the reattaching step are preferably the Fuji Film DT200 or DT100 and AT200 or AT100, respectively.

The APS can also be enjoyed by PHOTO JOY SYSTEM whose main component is the Fuji Film Aladdin 1000 digital image scanner. For example, a developed APS cartridge film is directly loaded into the Aladdin 1000, or image information of a negative film, positive film, or print is input to the Aladdin 1000 by using the FE-550 35-mm film scanner or the PE-550 flat head scanner. Obtained digital image data can be easily processed and edited. This data can be printed out by the NC-550AL digital color printer using a photo-fixing heat-sensitive color printing system or the PICTOROGRAPHY 3000 using a laser exposure thermal development transfer system, or by existing laboratory equipment through a film recorder. The Aladdin 1000 can also output digital information directly to a floppy disk or Zip disk or to an CD-R via a CD writer.

In a home, a user can enjoy photographs on a TV set simply by loading a developed APS cartridge film into the Fuji Film Photo Player AP-1. Image information can also be continuously input to a personal computer by loading a developed APS cartridge film into the Fuji Film Photo Scanner AS-1. The Fuji Film Photo Vision FV-10 or FV-5 can be used to input a film, print, or three-dimensional object. Furthermore, image information recorded in a floppy disk, Zip disk, CD-R, or hard disk can be variously processed on a computer by using the Fuji Film Photo Factory application software. The Fuji Film NC-2 or NC-2D digital color printer using a photo-fixing heat-sensitive color printing system is suited to outputting high-quality prints from a personal computer.

To keep developed APS cartridge films, the FUJICOLOR POCKET ALBUM AP-5 POP L, AP-1 POP L, or AP-1 POP KG, or the CARTRIDGE FILE 16 is preferable.

The examples of the present invention will be set forth below, however, the present invention is not limited to these examples.

EXAMPLE 1

Working example relating to the preparation of dislocation tabular emulsions having varied aspect ratios and shell thicknesses, application of raw emulsion and evaluation.

The gelatins 1 to 4 used as a dispersion medium in the following preparation of silver iodide fine grain emulsion have the following characteristics:

gelatin-1:

conventional alkali-treated ossein gelatin prepared from cattle bone as a raw material. No —$NH_2$ groups were chemically modified;

gelatin-2:

gelatin obtained by adding succinic acid to an aqueous solution of gelatin-1 at 50° C. and at a pH value of 9.0 to thereby effect a chemical reaction, removing remaining succinic acid and drying. The ratio of —$NH_2$ groups which are chemically modified was 95% by number;

gelatin-3:

gelatin obtained by causing an enzyme to act on gelatin-1 to thereby reduce the molecular weight thereof to an average molecular weight of 15,000, deactivating the enzyme and drying. No —$NH_2$ groups were chemically modified. The methionine content was 42 μmol/g; and gelatin-4:

gelatin obtained by adding aqueous hydrogen peroxide to an aqueous solution of gelatin-3 to thereby effect a chemical reaction and deactivating remaining hydrogen peroxide with the use of catalase. No —$NH_2$ groups were chemically modified. The methionine content was 3.4 μmol/g.

All the above gelatins 1 to 4 were deionized and adjusted so that the pH value exhibited by a 5% aqueous solution thereof at 35° C. was 6.0.

(Preparation of Emulsion A-1)

1,300 mL of an aqueous solution containing 1.0 g of KBr and 1.1 g of gelatin-3 described above was stirred at 35° C. (1st solution preparation). 76 mL of an aqueous solution Ag-1 (containing 4.9 g of $AgNO_3$ in 100 mL), 58 mL of an aqueous solution X-1 (containing 5.2 g of KBr in 100 mL), and 17 mL of an aqueous solution G-1 (containing 8.0 g of gelatin-3 described above in 100 mL) were added over 30 sec at fixed flow rates by the triple jet method (Addition 1). After that, 6.5 g of KBr were added, and the temperature was raised to 75° C. After the temperature was rised, a ripening step was performed for 12 min, then, 300 mL of an aqueous solution G-2 (containing 12.7 g of gelatin-2 described above in 100 mL) were added. 2.1 g of 4,5-dihydroxy-1,3-disodium disulfonate-monohydrate and 0.002 g of thiourea dioxide were sequentially added at an interval of 1 min.

Next, 157 mL of an aqueous solution Ag-2 (containing 22.1 g of $AgNO_3$ in 100 mL) and an aqueous solution X-2 (containing 15.5 g of KBr in 100 mL) were added over 14 min by the double jet method. The flow rate of the aqueous solution Ag-2 during the addition was accelerated such that the final flow rate was 3.4 times the initial flow rate. Also, the aqueous solution X-2 was so added that the pAg of the bulk emulsion solution in the reaction vessel was held at 8.30 (Addition 2). Subsequently, 329 mL of an aqueous solution Ag-3 (containing 32.Og of $AgNO_3$ in 100 mL) and an aqueous solution X-3 (containing 21.5 g of KBr and 1.2 g of KI in 100 mL) were added over 27 min by the double jet method. The flow rate of the aqueous solution Ag-3 during the addition was accelerated such that the final flow rate was 1.6 times the initial flow rate. Also, the aqueous solution X-3 was so added that the pAg of the bulk emulsion solution in the reaction vessel was held at 8.30 (Addition 3). Furthermore, 156 mL of an aqueous solution Ag-4 (containing 32.0 g of $AgNO_3$ in 100 mL) and an aqueous solution X-4 (containing 22.4 g of KBr in 100 mL) were added over 17 min by the double jet method. The addition of the aqueous solution Ag-4 was performed at a fixed flow rate. The addition of the aqueous solution X-4 was so performed that the pAg of the bulk emulsion solution in the reaction vessel was held at 7.52 (Addition 4).

After that, 0.0025 g of sodium benzenethiosulfonate and 125 mL of an aqueous solution G-3 (containing 12.0 g of gelatin-1 described above in 100 mL) were sequentially added at an interval of 1 min. 43.7 g of KBr were then added to adjust the pAg of the bulk emulsion solution in the reaction vessel to 9.00. 73.9 g of an AgI fine grain emulsion (containing 13.0 g of AgI fine grains having an average grain size of 0.047 μm in 100 g) were added. Two minutes after that, 249 mL of the aqueous solution Ag-4 and the aqueous solution X-4 were added by the double jet method. The addition of the aqueous solution Ag-4 was performed at a fixed flow rate over 9 min. The addition of the aqueous solution X-4 was performed only for the first 3.3 min such that the pAg of the bulk emulsion solution in the reaction vessel was held at 9.00. For the remaining 5.7 min the aqueous solution X-4 was not added so that the pAg of the bulk emulsion solution in the reaction vessel was finally 8.4 (Addition 5). After that, desalting was performed by conventional flocculation. Water, NaOH, and gelatin-1 described above were added under stirring, and the pH and the pAg were adjusted to 6.4 and 8.6, respectively, at 56° C.

The characteristic values of the thus obtained emulsion grains are set forth in Table 1 below.

TABLE 1

| Emulsion | Equivalent circle diameter (μm) Coefficient of variation (%) | Thickness (μm) Coefficient of variation (%) | Ratio in number of grains meeting condition A (%) | Ratio in number of grains meeting condition B (%) | Aspect ratio | Ratio of core/shell (%/%) | Ratio in number of grains whose shell thickness is 0.01 μm or more (%) | Ratio in number of grains whose shell thickness is 0.015 μm or more (%) | |
|---|---|---|---|---|---|---|---|---|---|
| A-1 | 1.49<br>22 | 0.125<br>27 | 21 | 5 | 12 | 70/30 | 95 | 78 | Comparison |
| A-2 | 1.72<br>28 | 0.094<br>30 | 52 | 22 | 18 | 85/15 | 38 | 12 | Comparison |
| A-3 | 1.82<br>23 | 0.084<br>17 | 72 | 28 | 22 | 70/30 | 56 | 23 | Invention |
| A-4 | 1.80<br>21 | 0.086<br>18 | 70 | 25 | 21 | 60/40 | 79 | 52 | Invention |
| A-5 | 2.06<br>24 | 0.066<br>17 | 96 | 53 | 31 | 60/40 | 53 | 22 | Invention |

TABLE 1-continued

| Emulsion | Equivalent circle diameter (μm) Coefficient of variation (%) | Thickness (μm) Coefficient of variation (%) | Ratio in number of grains meeting condition A (%) | Ratio in number of grains meeting condition B (%) | Aspect ratio | Ratio of core/shell (%/%) | Ratio in number of grains whose shell thickness is 0.01 μm or more (%) | Ratio in number of grains whose shell thickness is 0.015 μm or more (%) | |
|---|---|---|---|---|---|---|---|---|---|
| A-6 | 2.02<br>22 | 0.068<br>19 | 95 | 51 | 30 | 50/50 | 75 | 52 | Invention |

Condition A: Grains having an equivalent circle diameter of 1 μm or more and thickness of 0.1 μm or less.
Condition B: Grains having an equivalent circle diameter of 1 μm or more and thickness of 0.07 μm or less.

Subsequently, the emulsion was optimally, chemically sensitized by sequentially adding the sensitizing dye Exs-1 presented below, potassium thiocyanate, chloroauric acid, sodium thiosulfate, and N,N-dimethylselenourea. This chemical sensitization was completed by adding water-soluble mercapto compounds MER-1 and MER-2 presented below at a ratio of 4:1 such that the total amount was $3.6\times10^{-4}$ mol per mol of a silver halide. In the case of emulsion A-1, the optimum sensitization was performed when the addition amount of Exs-1 was $7.48\times10^{-4}$ mol per mol of a silver halide.

Exs-1

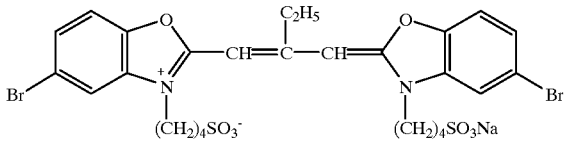

MER-1

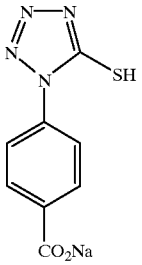

MER-2

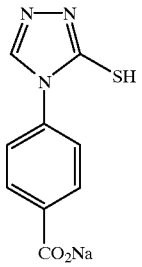

(Preparation of Emulsion A-2)

Emulsion A-2 was prepared under the same conditions as in the above preparation of emulsion A-1, except that the following changes were effected.

(1) The addition amount of Ag-3 aqueous solution of (Addition 3) was changed to 460 mL, and the addition was performed over a period of 46 min. The flow rate was increased so that the final flow rate was 1.7 times the initial flow rate. The addition of X-3 aqueous solution was performed while maintaining the pAg of the bulk emulsion solution at 8.44.

(2) The addition amount of AgI fine grain emulsion was changed to 98 g.

(3) The addition of Ag-4 aqueous solution of (Addition 5) was performed at the flow rate changed to 124 mL to thereby shorten the addition time to 4.5 min. The addition time of X-4 aqueous solution was shortened to 1.7 min.

The properties of emulsion A-2 are listed in Table 1.

The addition amount of sensitizing dye Exs-1 was adjusted so as to realize the optimum chemical sensitization.

(Preparation of Emulsion A-3)

Emulsion A-3 was prepared under the same conditions as in the above preparation of emulsion A-1, except that the following changes were effected.

(1) (Addition 2) and (Addition 3) were changed to the following addition.

1798 mL of Ag-5 aqueous solution (containing 9 g of $AgNO_3$ in 100 mL) and 1829 mL of X-5 aqueous solution (containing 6.2 g of KBr, 0.3 g of KI and 5 g of gelatin-3 in 100 mL) were mixed together by means of agitator described in JP-A-10-43570. The thus produced silver halide emulsion containing silver iodobromide superfine grains of 0.016 μm average size was discharged and immediately added over a period of 46 min at a constant flow rate. Simultaneously with the above addition, X-1 aqueous solution was added to the bulk emulsion solution while effecting such an adjustment that the pAg was maintained at 7.86 (Addition 6).

(2) The addition amount and addition time of Ag-4 aqueous solution of (Addition 4) were changed to 88 mL and 10 min, respectively. The pAg of the bulk emulsion solution was maintained at 8.15.

(3) The addition amount of AgI fine grain emulsion was changed to 110 g.

The properties of emulsion A-3 are listed in Table 1. The addition amount of sensitizing dye Exs-1 was adjusted so as to realize the optimum chemical sensitization.

(Preparation of Emulsion A-4)

Emulsion A-4 was prepared under the same conditions as in the above preparation of emulsion A-3, except that the following changes were effected.

(1) The gelatin-3 of the 1st liquid was changed to gelatin-4, and the addition amount thereof was 2.8 g.

(2) The gelatin of G-1 aqueous solution of (Addition 1) was changed to gelatin-4.

(3) The addition amounts of X-4 aqueous solution and Ag-5 aqueous solution of (Addition 6) were 1509 mL and 1483 mL, respectively. The addition time thereof was 38 min.

(4) The addition amount of AgI fine grain emulsion was changed to 108 g.

(5) 316 mL of Ag-4 aqueous solution of (Addition 5) was added over a period of 12 min. X-4 aqueous solution was added only for the initial 6.3 min.

The properties of emulsion A-4 are listed in Table 1. The addition amount of sensitizing dye Exs-1 was adjusted so as to realize the optimum chemical sensitization.

(Preparation of Emulsion A-5)

Emulsion A-5 was prepared under the same conditions as in the above preparation of emulsion A-4, except that the following changes were effected.

(1) The gelatin-4 of the 1st liquid was changed to gelatin-3, and the addition amount thereof was 1.1 g.

(2) The gelatin of G-1 aqueous solution of (Addition 1) was changed to gelatin-3.

(3) The gelatin-3 contained in X-4 aqueous solution of (Addition 6) was changed to gelatin-4, and the amount thereof was doubled.

(4) The addition amount of AgI fine grain emulsion was changed to 141 g.

The properties of emulsion A-5 are listed in Table 1. The addition amount of sensitizing dye Exs-1 was adjusted so as to realize the optimum chemical sensitization.

(Preparation of Emulsion A-6)

Emulsion A-6 was prepared under the same conditions as in the above preparation of emulsion A-5, except that the following changes were effected.

(1) The gelatin-3 of the 1st liquid was changed to gelatin-4, and the addition amount thereof was 2.5 g.

(2) The gelatin of G-1 aqueous solution of (Addition 1) was changed to gelatin-4.

(3) The addition amounts of X-4 aqueous solution and Ag-5 aqueous solution of (Addition 6) were 1189 mL and 1169 mL, respectively. The addition time thereof was 30 min.

(4) The addition amount of AgI fine grain emulsion was changed to 138 g.

(5) 426 mL of Ag-4 aqueous solution of (Addition 5) was added over a period of 21 min. X-4 aqueous solution was added only for the initial 15.3 min.

The properties of emulsion A-6 are listed in Table 1. The addition amount of sensitizing dye Exs-1 was adjusted so as to realize the optimum chemical sensitization.

The thus obtained emulsions A-1 to A-6 were observed through a 400 kV transmission electron microscope at liquid nitrogen temperature. It was found that, in all the silver halide emulsions except emulsion A-2, tabular grains having 30 or more dislocation lines at the fringe portions occupied 50% or more of all the grains. In emulsion A-2, grains having 10 or more dislocation lines per grain on the fringe portions occupied only 45% of all the grains.

Disodium 4,5-dihydroxy-1,3-disulfonatebenzene monohydrate and thiourea dioxide were added to the emulsions A-1 to A-6 just before (Addition 2) or (Addition 6) in the above process of emulsion preparation to thereby effect a reduction sensitization thereof.

Sensitizing dye Exs-1 was added to the emulsions A-1 to A-6 in the step of chemical sensitization during the emulsion preparation to thereby effect a spectral sensitization thereof. Thus, they became green-sensitive silver halide emulsions whose wavelength exhibiting the maximum spectral sensitivity was 550 nm.

A support of cellulose triacetate film furnished with a substratum was coated with each of the emulsions A-1 to A-6 under the coating condlitions as specified in Table 2 below. Thus, samples 101 to 106 were obtained.

TABLE 2

| Emulsion coating conditions | |
|---|---|
| (1) Emulsion layer | |
| Emulsions | Various emulsions (Silver $1.63 \times 10^{-2}$ mol/m$^2$) ($2.26 \times 10^{-3}$ mol/m$^2$) |
| Coupler | 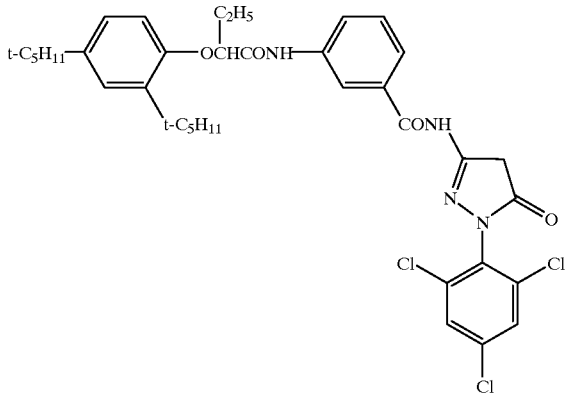 |
| Tricresyl phosphate | (1.32 g/m$^2$) |
| Gelatin | (3.24 g/m$^2$) |
| (2) Protective layer | |
| 2,4-dichloro-6-hydroxyl-s-triazine sodium salt | (0.08 g/m$^2$) |
| Gelatine | (1.80 g/m$^2$) |

These samples were subjected to a film hardening process at 40° C. and a relative humidity of 70% for 14 hr. The resultant samples were exposed for 1/100 sec through the SC-50 gelatin filter, a long wave length light-transmitting filter having a cut off wave length of 500 nm, manufactured by Fuji Photo Film Co., Ltd. and a continuous wedge. The density of each sample developed as will be described later was measured through a green filter to evaluate the photographic properties.

By using the FP-350 negative processor manufactured by Fuji Photo Film Co., Ltd., the resultant samples were processed by the following method (until the accumulated replenisher amount of each solution was three times the mother solution tank volume).

(Processing Method)

| Step | Time | Temperature | Replenishment rate* |
|---|---|---|---|
| Color Development | 2 min. 45 sec. | 38° C. | 45 mL |
| Bleaching | 1 min. 00 sec. | 38° C. | 20 mL bleaching solution overflow was entirely supplied into bleach-fix tank |
| Bleach-fix | 3 min. 15 sec. | 38° C. | 30 mL |
| Washing (1) | 40 sec. | 35° C. | counter flow piping from (2) to (1) |

-continued (Processing Method)

| Step | Time | Temperature | Replenishment rate* |
|---|---|---|---|
| Washing (2) | 1 min. 00 sec. | 35° C. | 30 mL |
| Stabilization | 40 sec. | 38° C. | 20 mL |
| Drying | 1 min. 15 sec. | 55° C. | |

*The replenishment rate is represented by a value per 1.1 m of a 35-mm wide sample (equivalent to one role of 24 Ex. film).

The compositions of the processing solutions are presented below.

| (Color developer) | Tank solution (g) | Replenisher (g) |
|---|---|---|
| Diethylenetriamine pentaacetic acid | 1.0 | 1.1 |
| 1-hydroxyethylidene-1,1-diphosphonic acid | 2.0 | 2.0 |
| Sodium sulfite | 4.0 | 4.4 |
| Potassium carbonate | 30.0 | 37.0 |
| Potassium bromide | 1.4 | 0.7 |
| Potassium iodide | 1.5 mg | — |
| Hydroxyaminesulfate | 2.4 | 2.8 |
| 4-[N-ethyl-N-(β-hydroxy ethyl)amino]-2-methyl aniline sulfate | 4.5 | 5.5 |
| Water to make | 1.0 L | 1.0 L |
| pH (adjusted by potassium hydroxide and sulfuric acid) | 10.05 | 10.10 |

| (Bleaching solution) common to tank solution and replenisher | (g) |
|---|---|
| Ferric ammonium ethylenediamine tetraacetate dihydrate | 120.0 |
| Disodium ethylenediamine tetraacetate | 10.0 |
| Ammonium bromide | 100.0 |
| Ammonium nitrate | 10.0 |
| Bleaching accelerator $(CH_3)_2N—CH_2—CH_2—S—S—CH_2—CH_2—N(CH_3)_2 \cdot 2HCl$ | 0.005 mol |
| Ammonia water (27%) | 15.0 mL |
| Water to make | 1.0 L |
| pH (adjusted by ammonia water and nitric acid) | 6.3 |

| (Bleach-fix bath) | Tank solution (g) | Replenisher (g) |
|---|---|---|
| Ferric ammonium ethylene diaminetetraacetate dihydrate | 50.0 | — |
| Disodium ethylenediamine tetraacetate | 5.0 | 2.0 |
| Sodium sulfite | 12.0 | 20.0 |
| Aqueous ammonium thiosulfate solution (700 g/L) | 240.0 mL | 400.0 mL |
| Ammonia water (27%) | 6.0 mL | — |
| Water to make | 1.0 L | 1.0 L |
| pH (adjusted by ammonia water and acetic acid) | 7.2 | 7.3 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 0.15 g/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Disodium ethylenediaminetetraacetate | 0 .05 |
| 1,2,4-triazole | 1.3 |
| 1,4-bis(1,2,4-triazole-1-ylmethyl) piperazine | 0.75 |
| Water to make | 1.0 L |
| pH | 8.5 |

Evaluation results are listed in Table 3 below. The sensitivity was expressed by the relative value of inverse number of exposure required for producing a fog density plus 0.2 (provided that the sensitivity of sample 101 was regarded as 100).

Pressure characteristics were tested by the following testing method A. Thereafter, the samples were subjected to exposure for sensitometry, and color development thereof was effected in the same manner as described above.

Testing Method A:

In this test, each sample was placed in an atmosphere of 55% relative humidity for 3 hr or more, and, in the same atmosphere, a load of 4 g was applied thereto by means of a needle of 0.1 mm diameter and the emulsion surface of the sample was scratched by the needle at a speed of 1 cm/sec.

With respect to the developed samples, the densities of pressed portions and nonpressed portions were measured by means of a 5 μm×1 mm measuring slit. Pressure marks occurred at nondeveloped portions. The results of sensitivity and pressure marks are listed in Table 3 (the pressure marks of sample 101 were regarded as 100).

TABLE 3

| Sample | Emulsion | Sensitivity | Pressure marks |
|---|---|---|---|
| 101 | A-1 | 100 | 100 |
| 102 | A-2 | 106 | 115 |
| 103 | A-3 | 125 | 104 |
| 104 | A-4 | 130 | 100 |
| 105 | A-5 | 134 | 105 |
| 106 | A-6 | 142 | 101 |

As apparent from Table 3, highly sensitive silver halide photographic emulsions ensuring a reduction of pressure mark deterioration could be obtained by the present invention.

EXAMPLE 2

Silver halide emulsions D to G. H-1, I-a, I-b and J to R were prepared in the following manner.

(Manufacturing Method of Emulsion D)

42.2L of an aqueous solution containing 31.7 g of low-molecular-weight gelatin phthalated at a phthalation ratio of 97% and 31.7 g of KBr were vigorously stirred at 35° C. 1,583 mL of an aqueous solution containing 316.7 g of $AgNO_3$ and 1,583 mL of an aqueous solution containing 221.5 g of KBr and 52.7 g of gelatin-3 of Example 1 were added over 1 min by the double jet method. Immediately after the addition, 52.8 g of KBr were added, and 2,485 mL of an aqueous solution containing 398.2 g of $AgNO_3$ and 2,581 mL of an aqueous solution containing 291.1 g of KBr were added over 2 min by the double jet method. Immediately after the addition, 44.8 g of KBr were added. After that, the temperature was raised to 40° C. to ripen the material. After the ripening, 923 g of gelatin-2 of Example 1 and 79.2 g of KBr were added, and 15,947 mL of an aqueous solution containing 5,103 g of $AgNO_3$ and an aqueous KBr solution were added over 10 min by the double jet method while the flow rate was accelerated such that the final flow rate was 1.4 times the initial flow rate. During the addition, the pAg of the bulk emulsion solution in the reaction vessel was held at 9.90. After washing with water, gelatin-1 of Example 1 was added, the pH and the pAg were adjusted to 5.7 and 8.8, respectively, and the silver amount and the gelatin amount were adjusted to 131.8 g and 64.1 g, respectively, per kg of the emulsion, thereby preparing a seed emulsion. 1,211 mL of an aqueous solution containing 46 g of gelatin-2 of Example 1 and 1.7 g of KBr were vigorously stirred at 75° C. After 9.9 g of the seed emulsion were added, 0.3 g of modified silicone oil (L7602 manufactured by Nippon Uniker K.K.) was added. $H_2SO_4$ was added to adjust the pH to 5.5, and 67.6 mL of an aqueous solution containing 7.0 g of $AgNO_3$ and an aqueous KBr solution were added over 6 min by the double jet method while the flow rate was accelerated such that the final flow rate was 5.1 times the initial flow rate. During the addition, the pAg of the bulk emulsion solution in the reaction vessel was held at 8.15. After 2 mg of sodium benzenethiosulfonate and 2 mg of thiourea dioxide were added, 328 mL of an aqueous solution containing 105.6 g of $AgNO_3$ and an aqueous KBr solution were added over 56 min by the double jet method while the flow rate was accelerated such that the final flow rate was 3.7 times the initial flow rate. During the addition, an AgI fine grain emulsion having a grain size of 0.037 $\mu$m was simultaneously added at an accelerated flow rate so that the silver iodide content was 27 mol %. At the same time, the pAg of the bulk emulsion solution in the reaction vessel was held at 8.60. 121.3 mL of an aqueous solution containing 45.6 g of $AgNO_3$ and an aqueous KBr solution were added over 22 min by the double jet method. During the addition, the pAg of the bulk emulsion solution in the reaction vessel was held at 7.60. The temperature was raised to 82° C., KBr was added to adjust the pAg of the bulk emulsion solution in the reaction vessel to 8.80, and the abovementioned AgI fine grain emulsion was added in an amount of 6.33 g in terms of a KI weight. Immediately after the addition, 206.2 mL of an aqueous solution containing 66.4 g of $AgNO_3$ were added over 16 min. For the first 5 min of the addition, the pAg of the bulk emulsion solution in the reaction vessel was held at 8.80. After washing with water, gelatin-1 of Example 1 was added, the pH and the pAg were adjusted to 5.8 and 8.7, respectively, at 40° C. After TAZ-1 was added, and the temperature was raised to 60° C. After sensitizing dyes Exs-2 and Exs-3 were added, potassium thiocyanate, chloroauric acid, sodium thiosulfate, and N,N-dimethylselenourea were added to optimally perform chemical sensitization. At the end of this chemical sensitization, MER-1 and MER-3 were added. "Optimal chemical sensitization" means that the addition amount of each of the sensitizing dyes and the compounds was $10^{-1}$ to $10^{-8}$ mol per mol of a silver halide.

TAZ-1

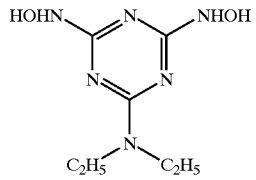

Exs-2

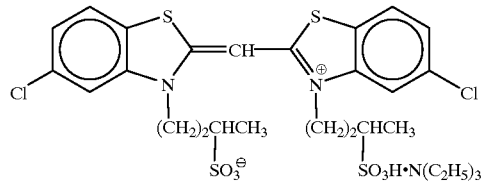

Exs-3

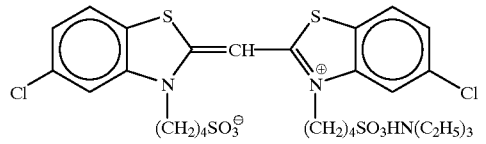

MER-1

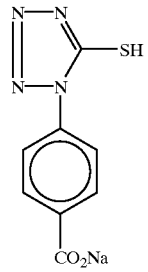

MER-3

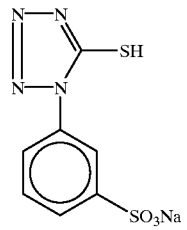

(Manufacturing Method of Emulsion E)

1,192 mL of an aqueous solution containing 0.96 g of gelatin-3 of Example 1 and 0.9 g of KBr were vigorously stirred at 40° C. 37.5 mL of an aqueous solution containing 1.49 g of $AgNO_3$ and 37.5 mL of an aqueous solution containing 1.05 g of KBr were added over 30 sec by the double jet method. After 1.2 g of KBr were added, the temperature was raised to 75° C. to ripen the material. After the ripening, 35 g of gelatin-3 of Example 1 were added, and the pH was adjusted to 7. 6 mg of thiourea dioxide were added. 116 mL of an aqueous solution containing 29 g of $AgNO_3$ and an aqueous KBr solution were added by the double jet method while the flow rate was accelerated such that the final flow rate was 3 times the initial flow rate. During the addition, the pAg of the bulk emulsion solution in the reaction vessel was held at 8.15. 440.6 mL of an aqueous solution containing 110.2 g of $AgNO_3$ and an aqueous KBr solution were added over 30 min by the double jet method while the flow rate was accelerated such that the final flow rate was 5.1 times the initial flow rate. During the addition, the AgI fine grain emulsion used in the preparation of the emulsion D was simultaneously added at an accelerated flow rate so that the silver iodide content was 15.8 mol %. At the same time, the pAg of the bulk emulsion solution in the reaction vessel was held at 7.85. 96.5 mL of an aqueous solution containing 24.1 g of $AgNO_3$ and an aqueous KBr solution were added over 3 min by the double jet method. During the addition, the pAg of the bulk emulsion solution in the reaction vessel was held at 7.85. After 26 mg of sodium ethylthiosulfonate were added, the temperature was raised to 55° C., an aqueous KBr solution was added to adjust the pAg of the bulk emulsion solution in the reaction vessel to 9.80. The aforementioned AgI fine grain emulsion was added in an amount of 8.5 g in terms of a KI weight. Immediately after the addition, 228 mL of an aqueous solution containing 57 g of $AgNO_3$ were added over 5 min. During the addition, an aqueous KBr solution was used to adjust the pAg of the bulk emulsion solution in the reaction vessel such that the pAg was 8.75 at the end of the addition. The resultant emulsion was washed with water and chemically sensitized in substantially the same manner as for the emulsion D.

(Manufacturing Method of Emulsion F)

1,192 mL of an aqueous solution containing 1.02 g of gelatin-2 of Example 1 and 0.9 g of KBr were vigorously stirred at 35° C. 42 mL of an aqueous solution containing 4.47 g of $AgNO_3$ and 42 mL of an aqueous solution containing 3.16 g of KBr were added over 9 sec by the double jet method. After 2.6 g of KBr were added, the temperature was raised to 63° C. to ripen the material. After the ripening, 41.2 g of gelatin-3 of Example 1 and 18.5 g of NaCl were added. After the pH was adjusted to 7.2, 8 mg of dimethylamineborane were added. 203 mL of an aqueous solution containing 26 g of $AgNO_3$ and an aqueous KBr solution were added by the double jet method while the flow rate was accelerated such that the final flow rate was 3.8 times the initial flow rate. During the addition, the pAg of the bulk emulsion solution in the reaction vessel was held at 8.65. 440.6 mL of an aqueous solution containing 110.2 g of $AgNO_3$ and an aqueous KBr solution were added over 24 min by the double jet method while the flow rate was accelerated such that the final flow rate was 5.1 times the initial flow rate. During the addition, the AgI fine grain emulsion used in the preparation of the emulsion D was simultaneously added at an accelerated flow rate so that the silver iodide content was 2.3 mol %. At the same time, the pAg of the bulk emulsion solution in the reaction vessel was held at 8.50. After 10.7 mL of an aqueous 1 N potassium thiocyanate solution were added, 153.5 mL of an aqueous solution containing 24.1 g of $AgNO_3$ and an aqueous KBr solution were added over 2 min 30 sec by the double jet method. During the addition, the pAg of the bulk emulsion solution in the reaction vessel was held at 8.05. An aqueous KBr solution was added to adjust the pAg of the bulk emulsion solution in the reaction vessel to 9.25. The aforementioned AgI fine grain emulsion was added in an amount of 6.4 g in terms of a KI weight. Immediately after the addition, 404 mL of an aqueous solution containing 57 g of $AgNO_3$ were added over 45 min. During the addition, an aqueous KBr solution was used to adjust the pAg of the bulk emulsion solution in the reaction vessel such that the pAg was 8.65 at the end of the addition. The resultant emulsion was washed with water and chemically sensitized in substantially the same manner as for the emulsion D.

(Manufacturing Method of Emulsion G)

In the preparation of the emulsion F, the $AgNO_3$ addition amount during nucleation was increased by 2.3 times. Also, in the final addition of 404 mL of an aqueous solution containing 57 g of $AgNO_3$, the pAg of the bulk emulsion solution in the reaction vessel was adjusted to 6.85 by using an aqueous KBr solution. An emulsion was prepared following substantially the same procedures as for the emulsion F except the foregoing.

(Preparation of Emulsion H-1)

Emulsion H-1 was prepared in substantially the same manner as in the preparation of emulsion A-1 of Example 1, except that a step of adding TAZ-1 was implemented prior to the chemical sensitization and that the sensitizing dye added in the initial stage of the chemical sensitization was changed to a combination of Exs-1, Exs-4 and Exs-5. The addition amounts of sensitizing dyes were regulated so that the molar ratio of Exs-1:Exs-4:Exs-5 was 75:18:7 and that the photographic sensitivity was maximized.

TAZ-1

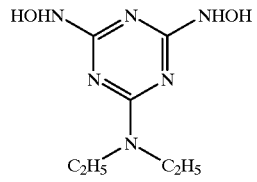

Exs-4

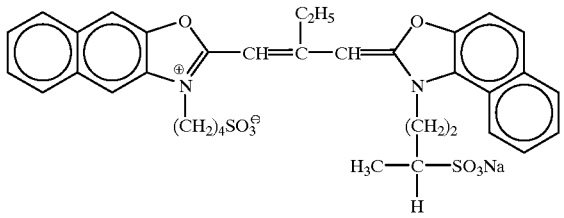

Exs-5

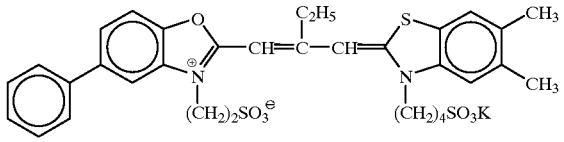

(Manufacturing Method of Emulsion I-a)

1,200 mL of an aqueous solution containing 0.75 g of gelatin-3 of Example 1 and 0.9 g of KBr were held at 39° C. and stirred with violence at pH 1.8. An aqueous solution containing 1.85 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. After the pH was adjusted to 5.9, 2.9 g of KBr were added. 288 mL of an aqueous solution containing 27.4 g of $AgNO_3$ and an aqueous KBr solution were added over 53 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 63 min by the double jet method while the flow rate was accelerated so that the final flow rate was 1.2 times the initial flow rate. During the addition, abovementioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 25 min by the double jet method. The addition of the aqueous KBr solution was so adjusted that the pAg of the bulk emulsion solution in the reaction vessel was 8.15 at the end of the addition. The pH was adjusted to 7.3, and 1 mg of thiourea dioxide was added. After KBr was added to adjust the pAg of the bulk emulsion solution in the reaction vessel to 9.50, the aforementioned AgI fine grain emulsion was added in an amount of 8.78 in terms of a KI weight. Immediately after the addition, 609 mL of an aqueous solution containing 63.3 g of $AgNO_3$ were added over 10 min. For the first 6 min of the addition, the pAg of the bulk emulsion solution in the reaction vessel was held at 9.50 by an aqueous KBr solution. After washing with water, gelatin-1 of Example 1 was added, and the pH and the pAg were adjusted to 6.5 and 8.2, respectively. The resultant emulsion was chemically sensitized in the same manner as for the emulsion H-1. Note that the use amounts of the sensitizing dyes Exs-1, EXS-4, and Exs-5 were $1.08\times10^{-3}$ mol, $2.56\times10^{-4}$ mol, and $9.16\times10^{-5}$ mol, respectively, per mol of a silver halide.

(Manufacturing Method of Emulsion J)

1,200 mL of an aqueous solution containing 0.70 g of gelatin-3 of Example 1, 0.9 g of KBr, 0.175 g of KI, and 0.2 g of the modified silicone oil used in the preparation of the emulsion D were held at 33° C. and stirred with violence at pH 1.8. An aqueous solution containing 1.8 g of $AgNO_3$ and an aqueous KBr solution containing 3.2 mol % of KI were added over 9 sec by the double jet method. During the addition, the excess KBr concentration was held constant. The temperature was raised to 62° C. to ripen the material. After the ripening, 27.8 g of gelatin-3 of Example 1 were added. After the pH was adjusted to 6.3, 2.9 g of KBr were added. 270 mL of an aqueous solution containing 27.58 g of $AgNO_3$ and an aqueous KBr solution were added over 37 min by the double jet method. During the addition, an AgI fine grain emulsion having a grain size of 0.008 $\mu$m was simultaneously added such that the silver iodide content was 4.1 mol %. This AgI fine grain emulsion was prepared, immediately before the addition, by mixing an aqueous solution of gelatin-3 of Example 1, an aqueous $AgNO_3$ solution, and an aqueous KI solution in another chamber having a magnetic coupling inductive stirrer described in JP-A-10-43570. At the same time, the pAg of the bulk emulsion solution in the reaction vessel was held at 9.15. After 2.6 g of KBr were added, an aqueous solution containing 87.7 g of $AgNO_3$ and an aqueous KBr solution were added over 49 min by the double jet method while the flow rate was accelerated so that the final flow rate was 3.1 times the initial flow rate. During the addition, the aforementioned AgI fine grain emulsion prepared by mixing immediately before addition was simultaneously added at an accelerated flow rate such that the silver iodide content was 7.9 mol %. At the same time, the pAg of the bulk emulsion solution in the reaction vessel was held at 9.30. After 1 mg of thiourea dioxide was added, 132 mL of an aqueous solution containing 41.8 g of $AgNO_3$ and an aqueous KBr solution were added over 20 min by the double jet method. The addition of the aqueous KBr solution was so adjusted that the pAg of the bulk emulsion solution in the reaction vessel as 7.90 at the end of the addition. After the temperature was raised to 78° C. and the pH was adjusted to 9.1, KBr was added to adjust the pAg of the bulk emulsion solution in the reaction vessel to 8.70. The AgI fine grain emulsion used in the preparation of the emulsion D was added in an amount of 5.73 g in terms of a KI weight. Immediately after the addition, 321 mL of an aqueous solution containing 66.4 g of $AgNO_3$ were added over 4 min. For the first 2 min of the addition, the pAg of the bulk emulsion solution in the reaction vessel was held at 8.70. The resultant emulsion was washed with water and chemically sensitized in substantially the same manner as for the emulsion H-1. Note that the use amounts of the sensitizing dyes Exs-1, Exs-4, and Exs-5 were $1.25\times10^{-3}$ mol, $2.85\times10^{-4}$ mol, $3.29\times10^{-5}$ mol, respectively, per mol of a silver halide.

(Manufacturing Method of Emulsion K)

An aqueous solution containing 17.8 g of gelatin-1 of Example 1, 6.2 g of KBr, and 0.46 g of KI was vigorously stirred at 45° C. An aqueous solution containing 11.85 g of $AgNO_3$ and an aqueous solution containing 3.8 g of KBr were added over 45 sec by the double jet method. After the temperature was raised to 63° C., 24.1 g of gelatin-1 of Example 1 were added to ripen the material. After the ripening, an aqueous solution containing 133.4 g of $AgNO_3$ and an aqueous KBr solution were added over 20 min by the double jet method such that the final flow rate was 2.6 times the initial flow rate. During the addition, the pAg of the bulk emulsion solution in the reaction vessel was held at 7.60. Also, ten minutes after the start of the addition 0.1 mg of $K_2IrCl_6$ was added. After 7 g of NaCl were added, an aqueous solution containing 45.6 g of $AgNO_3$ and an aqueous KBr solution were added over 12 min by the double jet method. During the addition, the pAg of the bulk emulsion solution in the reaction vessel was held at 6.90. Also, over 6 min from the start of the addition, 100 mL of an aqueous solution containing 29 mg of yellow prussiate were added. After 14.4 g of KBr were added, the AgI fine grain emulsion used in the preparation of the emulsion D was added in an amount of 6.3 g as a KI weight. Immediately after the addition, an aqueous solution containing 42.7 g of $AgNO_3$ and an aqueous KBr solution were added over 11 min by the double jet method. During the addition, the pAg of the bulk emulsion solution in the reaction vessel was held at 6.90. The resultant emulsion was washed with water and chemically sensitized substantially the same manner as for the emulsion H-1. Note that the use amounts of the sensitizing dyes Exs-1, Exs-4, and Exs-5 were $5.79\times10^{-4}$ mol, $1.32\times10^{-4}$ mol, $1.52\times10^{-5}$ mol, respectively, per mol of a silver halide.

(Manufacturing Method of Emulsion L)

An emulsion L was prepared following substantially the same procedures as for the emulsion K, except that the nucleation temperature was changed to 35° C. Note that the use amounts of the sensitizing dyes Exs-1, Exs-4, and Exs-5 were $9.66\times10^{-4}$ mol. $2.20\times10^{-4}$ mol, and $2.54\times10^{-5}$ mol, respectively, per mol of a silver halide.

(Manufacturing Method of Emulsion M)

1,200 mL of an aqueous solution containing 0.75 g of gelatin-3 of Example 1 and 0.9 g of KBr were held at 39° C. and vigorously stirred at pH 1.8. An aqueous solution containing 0.34 g of $AgNO_3$ and an aqueous KBr solution containing 1.5 mol % of KI were added over 16 sec by the double jet method. During the addition, the excess KBr concentration was held constant. The temperature was raised to 54° C. to ripen the material. After the ripening, 20 g of gelatin-2 of Example 1 were added. The pH was adjusted to 5.9, and 2.9 g of KBr were added. After 3 mg of thiourea dioxide were added, and 288 mL of an aqueous solution containing 28.8 g of $AgNO_3$ and an aqueous KBr solution were added over 58 min by the double jet method. During the addition, an AgI fine grain emulsion having a grain size of 0.03 $\mu$m was simultaneously added such that the silver iodide content was 4.1 mol %. At the same time, the pAg of the bulk emulsion solution in the reaction vessel was held at 9.40. After 2.5 g of KBr were added, an aqueous solution containing 87.7 g of $AgNO_3$ and an aqueous KBr solution were added over 69 min by the double jet method while the flow rate was accelerated so that the final flow rate was 1.2 times the initial flow rate. During the addition, the above-mentioned AgI fine grain emulsion was simultaneously added such that the silver iodide content was 10.5 mol %. At the same time, the pAg of the bulk emulsion solution in the reaction vessel was held at 9.50. 132 mL of an aqueous solution containing 41.8 g of $AgNO_3$ and an aqueous KBr solution were added over 27 min by the double jet method. The addition of the aqueous KBr solution was so adjusted that the pAg of the bulk emulsion solution in the reaction vessel was 8.15 at the end of the addition. After 2 mg of sodium benzenethiosulfonate were added, KBr was added to adjust the pAg of the bulk emulsion solution in the reaction vessel to 9.50, and the aforementioned AgI fine grain emulsion was added in an amount of 5.73 in terms of a KI weight. Immediately after the addition, 609 mL of an aqueous solution containing 66.4 g of $AgNO_3$ were added over 11 min. For the first 6 min of the addition, the pAg of the bulk emulsion solution in the reaction vessel was held at 9.50 by an aqueous KBr solution. After washing with water, gelatin was added, the pH and the pAg were adjusted to 6.5 and 8.2, respectively, at 40° C. Then, TAZ-1 was added and the temperature was raised to $_{56}$° C. The sensitizing dyes Exs-1 and Exs-6 were added. After that, potassium thiocyanate, chloroauric acid, sodium thiosulfate, and N,N-dimethylselenourea were added to ripen and optimally chemically sensitize the emulsion. At the end of the chemical sensitization, MER-1 and MER-3 were added. Note that the use amounts of the sensitizing dyes Exs-1 and Exs-6 were $3.69\times10^{-4}$ mol and $8.19\times10^{-4}$ mol, respectively, per mol of a silver halide.

TAZ-1

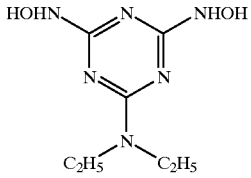

Exs-6

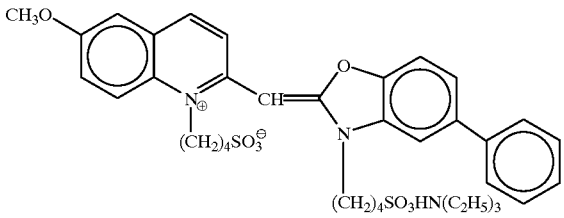

-continued

MER-1

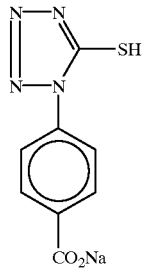

MER-3

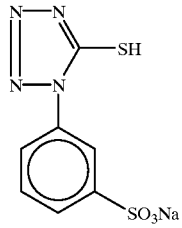

(Manufacturing Method of Emulsion N)

1,200 mL of an aqueous solution containing 0.38 g of gelatin-2 of Example 1 and 0.9 g of KBr were held at 60° C. and vigorously stirred at pH 2. An aqueous solution containing 1.03 g of $AgNO_3$ and an aqueous solution containing 0.88 g of KBr and 0.09 g of KI were added over 30 sec by the double jet method. After ripening, 12.8 g of gelatin-3 of Example 1 were added. After the pH was adjusted to 5.9, 2.99 g of KBr and 6.2 g of NaCl were added. 60.7 mL of an aqueous solution containing 27.3 g of $AgNO_3$ and an aqueous KBr solution were added over 39 min by the double jet method. During the addition, the pAg of the bulk emulsion solution in the reaction vessel was held at 9.05. An aqueous solution containing 65.6 g of $AgNO_3$ and an aqueous KBr solution were added over 46 min by the double jet method while the flow rate was accelerated so that the final flow rate was 2.1 times the initial flow rate. During the addition, the AgI fine grain emulsion used in the preparation of the emulsion D was simultaneously added at an accelerated flow rate such that the silver iodide content was 6.5 mol %. At the same time, the pAg of the bulk emulsion solution in the reaction vessel was held at 9.05. After 1.5 mg of thiourea dioxide were added, 132 mL of an aqueous solution containing 41.8 g and an aqueous KBr solution were added over 16 min by the double jet method. The addition of the aqueous KBr solution was so adjusted that the pAg of the bulk emulsion solution in the reaction vessel as 7.70 at the end of the addition. After 2 mg of sodium benzenethiosulfonate were added, KBr was added to adjust the pAg of the bulk emulsion solution in the reaction vessel to 9.80. The above-mentioned AgI fine grain emulsion was added in an amount of 6.2 g in terms of a KI weight. Immediately after the addition, 300 mL of an aqueous solution containing 88.5 g of $AgNO_3$ were added over 10 min. An aqueous KBr solution was added to adjust pAg of the bulk emulsion solution in the reaction vessel such that the pAg was 7.40 at the end of the addition. After washing with water, gelatin-1 of Example 1 was added, the pH and the pAg were adjusted to 6.5 and 8.2, respectively. After TAZ-1 was added, the temperature was raised to 58° C. The sensitizing dyes Exs-7, Exs-8, and Exs-9 were added. After that, $K_2IrCl_6$, potassium thiocyanate, chloroauric acid, sodium thiosulfate, and N,N-dimethylselenourea were added to optimally perform chemical sensitization. At the end of the chemical sensitization, MER-1 and MER-3 were added.

TAZ-1

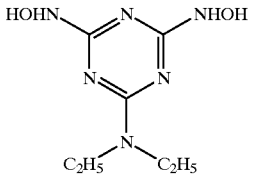

Exs-7

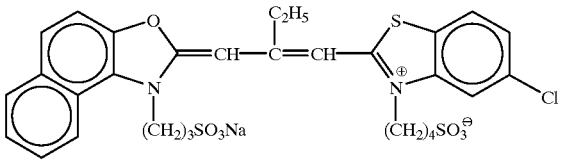

Exs-8

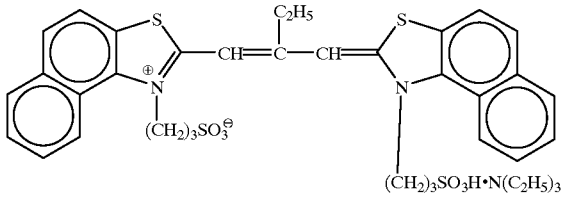

Exs-9

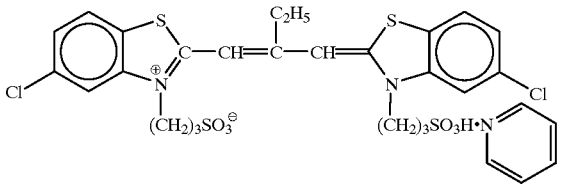

MER-1

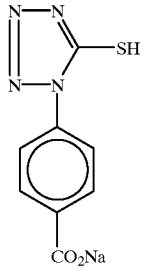

-continued

MER-3

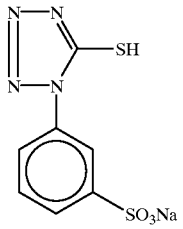

(Manufacturing Method of Emulsion O)

In the preparation of the emulsion N, the amounts of $AgNO_3$, KBr, and KI added during nucleation were changed to 1.96 g, 1.67 g, and 0.172 g, respectively. Also, the chemical sensitization temperature was changed from 58° C. to 61° C. An emulsion 0 was prepared following substantially the same procedures as for the emulsion N except the foregoing.

(Manufacturing Method of Emulsion P)

1,200 mL of an aqueous solution containing 4.9 g of gelatin-3 of Example 1 and 5.3 g of KBr were vigorously stirred at 40° C. 27 mL of an aqueous solution containing 8.75 g of $AgNO_3$ and 36 mL of an aqueous solution containing 6.45 g of KBr were added over 1 min by the double jet method. The temperature was raised to 75° C., and 21 mL of an aqueous solution containing 6.9 g of $AgNO_3$ were added over 2 min. After 26 g of $NH_4NO_3$ and 56 mL of 1 N NaOH were sequentially added, the material was ripened. After the ripening, the pH was adjusted to 4.8. 438 mL of an aqueous solution containing 141 g of $AgNO_3$ and 458 mL of an aqueous solution containing 102.6 g of KBr were added by the double jet method such that the final flow rate was 4 times the initial flow rate. The temperature was lowered to 55° C., 240 mL of an aqueous solution containing 7.1 g of $AgNO_3$ and an aqueous solution containing 6.46 g of KI were added over 5 min by the double jet method. After 7.1 g of KBr were added, 4 mg of sodium benzenethiosulfonate and 0.05 mg of $K_2IrCl_6$ were added. 177 mL of an aqueous solution containing 57.2 g of $AgNO_3$ and 223 mL of an aqueous solution containing 40.2 g of KBr were added over 8 min by the double jet method. The resultant emulsion was washed with water and chemically sensitized in substantially the same manner as for the emulsion N.

(Manufacturing Methods of Emulsions Q and R)

Emulsions Q and R were prepared following substantially the same procedures as for the emulsions K and L, respectively, except that chemical sensitization was performed in substantially the same manner as for the emulsion O.

Characteristic values of the above silver halide emulsions are summarized in Table 4 below. Note that dislocation lines as described in JP-A-3-237450 were observed by a high-voltage electron microscope in silver halide grains of the emulsions D to G, H-1, I-a, and J to R.

TABLE 4

| Emulsion No. | Equivalent circle diameter (μm) Coefficient of variation (%) | Thickness (μm) Coefficient of variation (%) | Aspect ratio Coefficient of variation (%) | Tabularity | Distance between twin planes (μm) Coefficient of variation (%) | Ratio of (111) grains* (%) |
|---|---|---|---|---|---|---|
| D | 1.98 | 0.198 | 10 | 51 | 0.014 | 92 |
| | 23 | 28 | 35 | | 32 | |
| E | 1.30 | 0.108 | 12 | 111 | 0.013 | 93 |
| | 25 | 27 | 38 | | 30 | |
| F | 1.00 | 0.083 | 12 | 145 | 0.012 | 93 |
| | 27 | 26 | 37 | | 30 | |
| G | 0.75 | 0.075 | 10 | 133 | 0.010 | 91 |
| | 31 | 18 | 29 | | 27 | |
| H-1 | 1.49 | 0.125 | 12 | 95 | 0.011 | 99 |
| | 22 | 27 | 30 | | 23 | |
| I-a | 1.54 | 0.077 | 20 | 260 | 0.013 | 99 |
| | 26 | 18 | 33 | | 26 | |
| J | 1.08 | 0.072 | 15 | 208 | 0.008 | 97 |
| | 18 | 15 | 19 | | 22 | |
| K | 0.44 | 0.220 | 2 | 9 | 0.013 | 90 |
| | 16 | 13 | 9 | | 18 | |
| L | 0.33 | 0.165 | 2 | 12 | 0.013 | 88 |
| | 17 | 13 | 12 | | 18 | |
| M | 2.25 | 0.107 | 21 | 197 | 0.013 | 99 |
| | 31 | 19 | 34 | | 33 | |
| N | 2.38 | 0.138 | 17 | 125 | 0.013 | 98 |
| | 20 | 20 | 23 | | 19 | |
| O | 1.83 | 0.122 | 15 | 123 | 0.012 | 98 |
| | 18 | 20 | 22 | | 19 | |
| P | 0.84 | 0.120 | 7 | 58 | 0.013 | 99 |
| | 17 | 18 | 19 | | 16 | |
| Q | 0.44 | 0.220 | 2 | 9 | 0.013 | 88 |
| | 17 | 13 | 12 | | 18 | |
| R | 0.33 | 0.165 | 2 | 12 | 0.013 | 88 |
| | 17 | 13 | 12 | | 18 | |
| S | 0.07 | 0.070 | 1 | — | — | — |
| | — | — | — | | — | |
| T | 0.07 | 0.070 | 1 | — | — | — |
| | — | — | — | | — | |

*Ratio of tabular grains having (111) main planes to the total projected area (%).

1) Support

A support used in this example was formed as follows.

100 parts by weight of a polyethylene-2,6-naphthalate polymer and 2 parts by weight of Tinuvin P.326 (manufactured by Ciba-Geigy Co.) as an ultraviolet absorbent were dried, melted at 300° C., and extruded from a T-die. The resultant material was longitudinally oriented by 3.3 times at 140° C., laterally oriented by 3.3 times at 130° C., and thermally fixed at 250° C. for 6 sec, thereby obtaining a 90 μm thick PEN (polyethylenenaphthalate) film. Note that proper amounts of blue, magenta, and yellow dyes (I-1, I-4, I-6, I-24, I-26, I-27, and II-5 described in Journal of Technical Disclosure No. 94-6023) were added to this PEN film. The PEN film was wound around a stainless steel core 20 cm in diameter and given a thermal history of 110° C. and 48 hr, manufacturing a support with a high resistance to curling.

2) Coating of Undercoat Layer

The two surfaces of the above support were subjected to corona discharge, UV discharge, and glow discharge. After that, each surface of the support was coated with an undercoat solution (10 mL/m$^2$, by using a bar coater) consisting of 0.1 g/m$^2$ of gelatin, 0.01 g/m$^2$ of sodium α-sulfodi-2-ethylhexylsuccinate, 0.04 g/m$^2$ of salicylic acid, 0.2 g/m$^2$ of p-chlorophenol, 0.012 g/m$^2$ of $(CH_2{=}CHSO_2CH_2CH_2NHCO)_2CH_2$, and 0.02 g/m$^2$ of a polyamido-epichlorohydrin polycondensation product, thereby forming an undercoat layer on a side at a high temperature upon orientation. Drying was performed at 115° C. for 6 min (all rollers and conveyors in the drying zone were at 115° C.).

3) Coating of Back Layers

One surface of the undercoated support was coated with an antistatic layer, magnetic recording layer, and slip layer having the following compositions as back layers.

3-1) Coating of Antistatic Layer

The surface was coated with 0.2 g/m$^2$ of a dispersion (secondary aggregation grain size=about 0.08 μm) of a fine-grain powder, having a specific resistance of 5 Ω·cm, of a tin oxide-antimony oxide composite material with an average grain size of 0.005 μm, together with 0.05 g/m$^2$ of gelatin, 0.02 g/m$^2$ of $(CH_2{=}CHSO_2CH_2CH_2NHCO)_2CH_2$, 0.005 g/m$^2$ of polyoxyethylene-p-nonylphenol (polymerization degree 10), and resorcin.

3-2) Coating of Magnetic Recording Layer

A bar coater was used to coat the surface with 0.06 g/m$^2$ of cobalt-γ-iron oxide (specific area 43 m$^2$/g, major axis 0.14 μm, minor axis 0.03 μm, saturation magnetization 89 Am$^2$/kg, $Fe^{+2}/Fe^{+3}$=6/94, the surface was treated with 2 wt % of iron oxide by aluminum oxide silicon oxide) coated with 3-poly(polymerization degree 15)oxyethylene-propyloxytrimethoxysilane (15 wt %), together with 1.2 g/m$^2$ of diacetylcellulose (iron oxide was dispersed by an open kneader and sand mill), by using 0.3 g/m$^2$ of $C_2H_5C(CH_2OCONH{-}C_6H_3(CH_3)NCO)_3$ as a hardener and acetone, methylethylketone, and cyclohexane as solvents, thereby forming a 1.2-μm thick magnetic recording layer. 10 mg/m$^2$ of silica grains (0.3 μm) were added as a matting agent, and 10 mg/m$^2$ of aluminum oxide (0.15 $\mu$m) coated with 3-poly(polymerization degree 15)oxyethylene-propyloxytrimethoxysilane (15 wt %) were added as a polishing agent. Drying was performed at 115° C. for 6 min (all rollers and conveyors in the drying zone were at 115° C.). The color density increase of $D^B$ of the magnetic recording layer measured by an X-light (blue filter) was about 0.1. The saturation magnetization moment, coercive force, and squareness ratio of the magnetic recording layer were 4.2 Am$^2$/kg, 7.3×10$^4$ A/m, and 65%, respectively.

3-3) Preparation of Slip Layer

The surface was then coated with diacetylcellulose (25 mg/m$^2$) and a mixture of $C_6H_{13}CH(OH)C_{10}H_{20}COOC_{40}H_{81}$ (compound a, 6 mg/m$^2$)/$C_{50}H_{101}O(CH_2CH_2O)_{16}H$ (compound b, 9 mg/m$^2$). Note that this mixture was melted in xylene/propylenemonomethylether (1/1) at 105° C. and poured and dispersed in propylenemonomethylether (tenfold amount) at room temperature. After that, the resultant mixture was formed into a dispersion (average grain size 0.01 $\mu$m) in acetone before being added. 15 mg/m$^2$ of silica grains (0.3 $\mu$m) were added as a matting agent, and 15 mg/m$^2$ of aluminum oxide (0.15 $\mu$m) coated with 3-poly(polymerization degree 15) oxyethylene-propyloxytrimethoxysiliane (15 wt %) were added as a polishing agent. Drying was performed at 115° C. for 6 min (all rollers and conveyors in the drying zone were at 115° C.). The resultant slip layer was found to have excellent characteristics; the coefficient of kinetic friction was 0.06 (5 mmϕ stainless steel hard sphere, load 100 g, speed 6 cm/min), and the coefficient of static friction was 0.07 (clip method). The coefficient of kinetic friction between an emulsion surface (to be described later) and the slip layer also was excellent, 0.12.

4) Coating of Sensitive Layers

The surface of the support on the side away from the back layers formed as above was coated with a plurality of layers having the following compositions to form a sample as a color negative sensitized material, thereby to prepare Sample 201.

(Compositions of Sensitive Layers)

The main ingredients used in the individual layers are classified as follows, however, the use thereof are not limited to those specified below.

EXC: Cyan coupler UV: Ultraviolet absorbent
ExM: Magenta coupler HBS: High-boiling organic solvent
ExY: Yellow coupler H: Gelatin hardener (In the following description, practical compounds have numbers attached to their symbols. Formulas of these compounds will be presented later.)

The number corresponding to each component indicates the coating amount in units of g/m$^2$. The coating amount of a silver halide is indicated by the amount of silver.

| 1st layer (1st antihalation layer) | | |
|---|---|---|
| Black colloidal silver | silver | 0.155 |
| Silver iodobromide emulsion T | silver | 0.01 |
| Gelatin | | 0.87 |
| ExC-1 | | 0.002 |
| ExC-3 | | 0.002 |
| Cpd-2 | | 0.001 |
| HBS-1 | | 0.004 |
| HBS-2 | | 0.002 |

-continued

| 2nd layer (2nd antihalation layer) | | |
|---|---|---|
| Black colloidal silver | silver | 0.066 |
| Gelatin | | 0.407 |
| ExM-1 | | 0.050 |
| ExF-1 | | 2.0 × 10$^{-3}$ |
| HBS-1 | | 0.074 |
| Solid disperse dye ExF-2 | | 0.015 |
| Solid disperse dye ExF-3 | | 0.020 |
| 3rd layer (Interlayer) | | |
| Silver iodobromide emulsion S | | 0.020 |
| ExC-2 | | 0.022 |
| Polyethylacrylate latex | | 0.085 |
| Gelatin | | 0.294 |
| 4th layer (Low-speed red-sensitive emulsion layer) | | |
| Silver iodobromide emulsion R | silver | 0.065 |
| Silver iodobromide emulsion Q | silver | 0.258 |
| ExC-1 | | 0.109 |
| ExC-3 | | 0.044 |
| ExC-4 | | 0.072 |
| ExC-5 | | 0.011 |
| ExC-6 | | 0.003 |
| Cpd-2 | | 0.025 |
| Cpd-4 | | 0.025 |
| HBS-1 | | 0.17 |
| Gelatin | | 0.80 |
| 5th layer (Medium-speed red-sensitive emulsion layer) | | |
| Silver iodobromide emulsion P | silver | 0.21 |
| Silver iodobromide emulsion O | silver | 0.62 |
| ExC-1 | | 0.14 |
| ExC-2 | | 0.026 |
| ExC-3 | | 0.020 |
| ExC-4 | | 0.12 |
| ExC-5 | | 0.016 |
| ExC-6 | | 0.007 |
| Cpd-2 | | 0.036 |
| Cpd-4 | | 0.028 |
| HBS-1 | | 0.16 |
| Gelatin | | 1.18 |
| 6th layer (High-speed red-sensitive emulsion layer) | | |
| Silver iodochlorobromide emulsion N | silver | 1.47 |
| ExC-1 | | 0.18 |
| ExC-3 | | 0.07 |
| ExC-6 | | 0.029 |
| ExC-7 | | 0.010 |
| ExY-5 | | 0.008 |
| Cpd-2 | | 0.046 |
| Cpd-4 | | 0.077 |
| HBS-1 | | 0.25 |
| HBS-2 | | 0.12 |
| Gelatin | | 2.12 |
| 7th layer (Interlayer) | | |
| Cpd-1 | | 0.089 |
| Solid disperse dye ExF-4 | | 0.030 |
| HBS-l | | 0.050 |
| Polyethylacrylate latex | | 0.83 |
| Gelatin | | 0.84 |
| 8th layer (layer for donating interimage effect to red-sensitive layer) | | |
| Silver iodobromide emulsion M | silver | 0.560 |
| Cpd-4 | | 0.030 |
| ExM-2 | | 0.096 |
| ExM-3 | | 0.028 |
| ExY-1 | | 0.031 |
| ExG-1 | | 0.006 |
| HBS-1 | | 0.085 |
| HBS-3 | | 0.003 |
| Gelatin | | 0.58 |
| 9th layer (Low-speed green-sensitive emulsion layer) | | |
| Silver iodobromide emulsion L | silver | 0.39 |
| Silver iodochlorobromide emulsion K | silver | 0.28 |
| Silver iodobromide emulsion J | silver | 0.35 |

-continued

| | | |
|---|---|---|
| ExM-2 | | 0.36 |
| ExM-3 | | 0.045 |
| ExG-1 | | 0.005 |
| HBS-1 | | 0.28 |
| HBS-3 | | 0.01 |
| HBS-4 | | 0.27 |
| Gelatin | | 1.39 |
| 10th layer (Medium-speed green-sensitive emulsion layer) | | |
| Silver iodobromide emulsion I-a | silver | 0.45 |
| ExC-6 | | 0.009 |
| ExM-2 | | 0.031 |
| ExM-3 | | 0.029 |
| ExY-1 | | 0.006 |
| ExM-4 | | 0.028 |
| ExG-1 | | 0.005 |
| HBS-1 | | 0.064 |
| HBS-3 | | $2.1 \times 10^{-3}$ |
| Gelatin | | 0.44 |
| 11th layer (High-speed green-sensitive emulsion layer) | | |
| Silver iodobromide emulsion I-a | silver | 0.30 |
| Silver iodobromide emulsion H-1 | silver | 0.69 |
| ExC-6 | | 0.004 |
| ExM-1 | | 0.016 |
| ExM-3 | | 0.036 |
| ExM-4 | | 0.020 |
| ExM-5 | | 0.004 |
| ExY-5 | | 0.003 |
| ExM-2 | | 0.013 |
| ExG-1 | | 0.005 |
| Cpd-4 | | 0.007 |
| HBS-1 | | 0.18 |
| Polyethylacrylate latex | | 0.099 |
| Gelatin | | 1.11 |
| 12th layer (Yellow filter layer) | | |
| Yellow colloidal silver | silver | 0.01 |
| Cpd-1 | | 0.16 |
| Oil-soluble dye ExF-5 | | 0.010 |
| Solid disperse dye ExF-6 | | 0.153 |
| HBS-1 | | 0.082 |
| Gelatin | | 1.057 |
| 13th layer (Low-speed blue-sensitive emulsion layer) | | |
| Silver iodobromide emulsion G | silver | 0.18 |
| Silver iodobromide emulsion E | silver | 0.20 |
| Silver iodochlorobromide emulsion F | silver | 0.07 |
| ExC-1 | | 0.041 |
| ExC-8 | | 0.012 |
| ExY-1 | | 0.035 |
| ExY-2 | | 0.71 |
| ExY-3 | | 0.10 |
| ExY-4 | | 0.005 |
| Cpd-2 | | 0.10 |
| Cpd-3 | | $4.0 \times 10^{-3}$ |
| HBS-1 | | 0.24 |
| Gelatin | | 1.41 |
| 14th layer (High-speed blue-sensitive emulsion layer) | | |
| Silver iodobromide emulsion D | silver | 0.75 |
| ExC-1 | | 0.013 |
| ExY-2 | | 0.31 |
| ExY-3 | | 0.05 |
| ExY-6 | | 0.062 |
| Cpd-2 | | 0.075 |
| Cpd-3 | | $1.0 \times 10^{-3}$ |
| HBS-1 | | 0.10 |
| Gelatin | | 0.91 |
| 15th layer (1st protective layer) | | |
| Silver iodobromide emulsion S | silver | 0.30 |
| UV-1 | | 0.21 |
| UV-2 | | 0.13 |
| UV-3 | | 0.20 |
| UV-4 | | 0.025 |
| F-11 | | 0.009 |
| F-18 | | 0.005 |

-continued

| | |
|---|---|
| F-19 | 0.005 |
| HBS-1 | 0.12 |
| HBS-4 | $5.0 \times 10^{-2}$ |
| Gelatin | 2.3 |
| 16th layer (2nd protective layer) | |
| H-1 | 0.40 |
| B-1 (diameter 1.7 $\mu$m) | $5.0 \times 10^{-2}$ |
| B-2 (diameter 1.7 $\mu$m) | 0.15 |
| B-3 | 0.05 |
| S-1 | 0.20 |
| Gelatin | 0.75 |

In addition to the above components, to improve the storage stability, processability, resistance to pressure, antiseptic and mildewproofing properties, antistatic properties, and coating properties, the individual layers contained W-1 to W-5, B-4 to B-6, F-1 to F-18, iron salt, lead salt, gold salt, platinum salt, palladium salt, iridium salt, ruthenium salt, and rhodium salt. Additionally, a sample was manufactured by adding $8.5\times10^{-3}$ g and $7.9\times10^{-3}$ g, per mol of a silver halide, of calcium in the form of an aqueous calcium nitrate solution to the coating solutions of the 8th and 11th layers, respectively.

Preparation of Dispersions of Organic Solid Disperse Dyes

ExF-3 was dispersed by the following method. That is, 21.7 mL of water, 3 mL of a 5% aqueous solution of p-octylphenoxyethoxyethanesulfonic acid soda, and 0.5 g of a 5% aqueous solution of p-octylphenoxypolyoxyethyleneether (polymerization degree 10) were placed in a 700 mL pot mill, and 5.0 g of the dye ExF-3 and 500 mL of zirconium oxide beads (diameter 1 mm) were added to the mill. The contents were dispersed for 2 hr. This dispersion was done by using a BO type oscillating ball mill manufactured by Chuo Koki K. K. After the dispersion, the dispersion was extracted from the mill and added to 8 g of a 12.5% aqueous solution of gelatin. The beads were filtered away to obtain a gelatin dispersion of the dye. The average grain size of the fine dye grains was 0.24 $\mu$m.

Following the same procedure as above, solid dispersions ExF-4 was obtained. The average grain sizes of the fine dye grains was 0.45. ExF-2 was dispersed by a microprecipitation dispersion method described in Example 1 of EP549, 489A. The average grain size was found to be 0.06 $\mu$m.

A solid dispersion ExF-6 was dispersed by the following method.

4.0 Kg of water and 376 g of a 3% solution of w-2 were added to 2,800 g of a wet cake of ExF-6 containing 18% of water, and the resultant material was stirred to form a slurry of ExF-6 having a concentration of 32%. Next, ULTRA VISCO MILL (UVM-2) manufactured by Imex K.K. was filled with 1,700 mL of zirconia beads having an average grain size of 0.5 mm. The slurry was milled by passing through the mill for 8 hr at a peripheral speed of about 10 m/sec and a discharge amount of 0.5 L/min.

Compounds used in the formation of each layer were as follows.

ExC-1
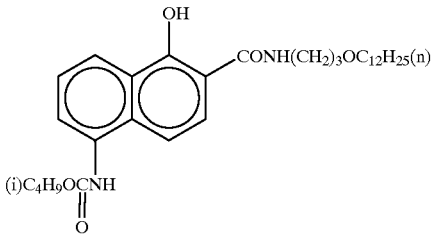
ExC-2
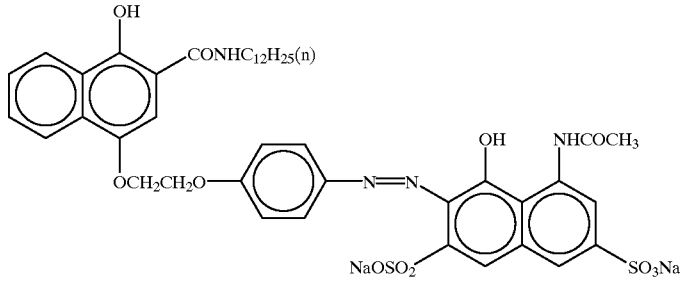
ExC-3
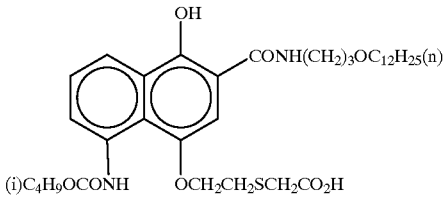
ExC-4
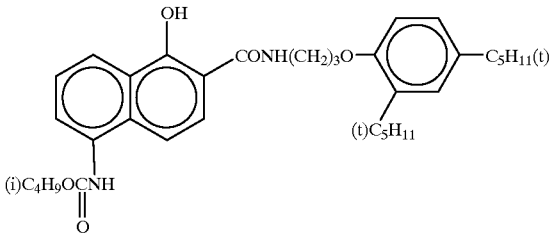
ExC-5
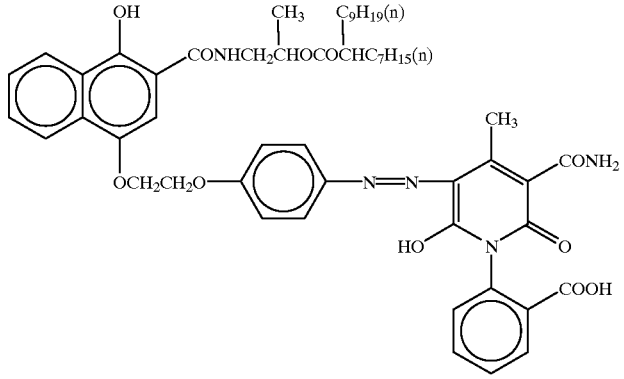
ExC-6
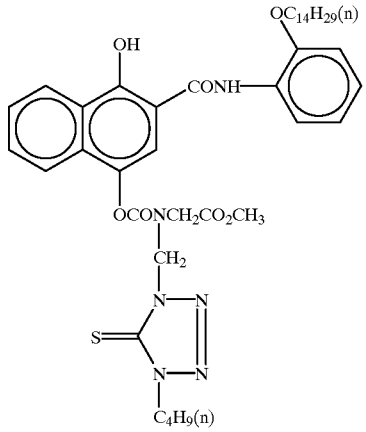
ExC-7
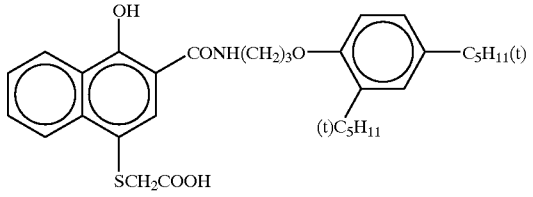

-continued
ExC-8
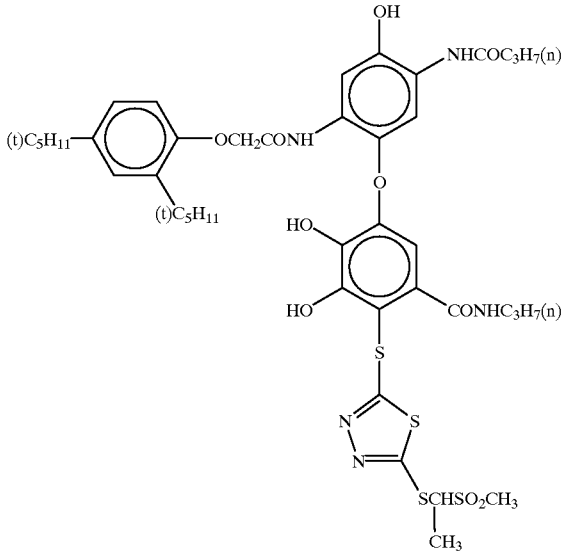
ExM-1
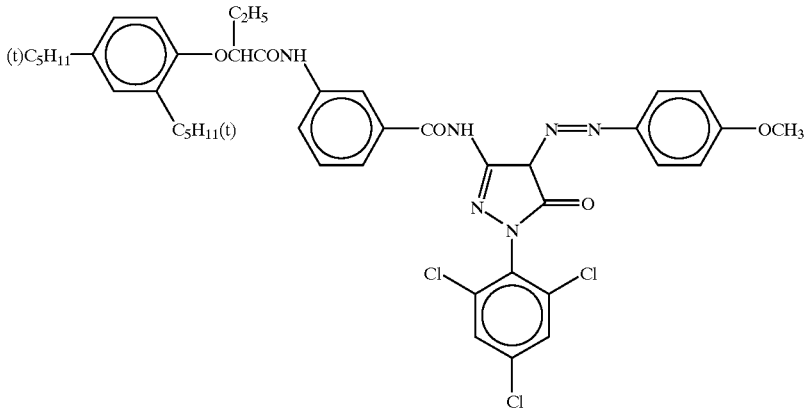
ExM-2
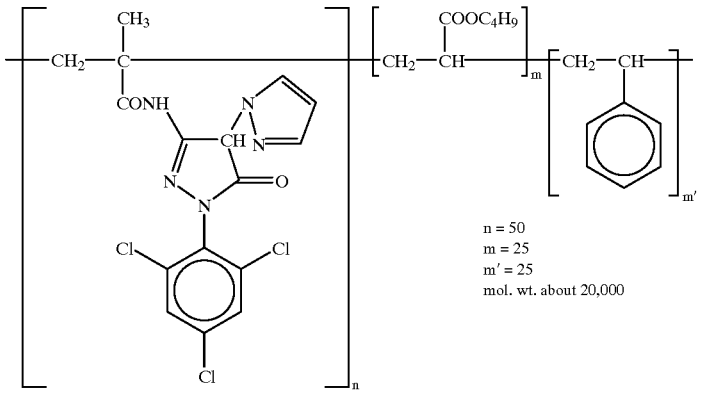

-continued
ExM-3
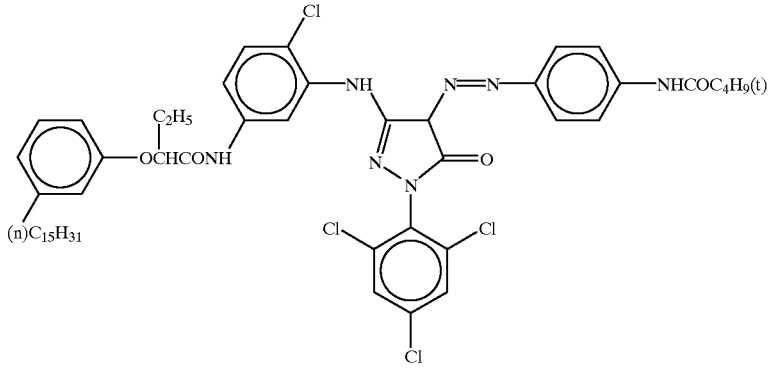
ExM-4
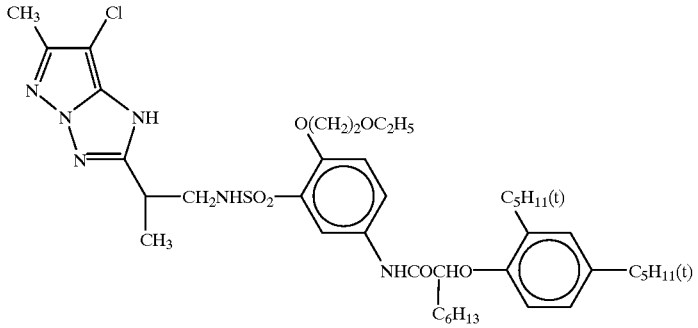
ExM-5
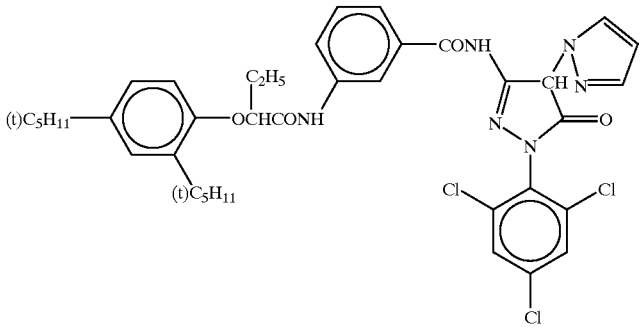
ExY-1
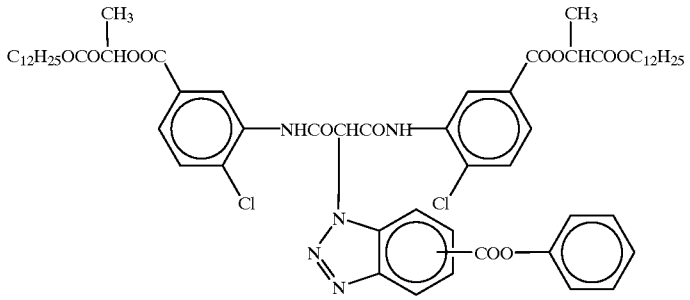

-continued
ExY-2
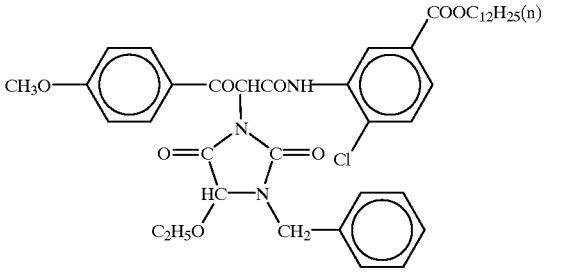
ExY-3
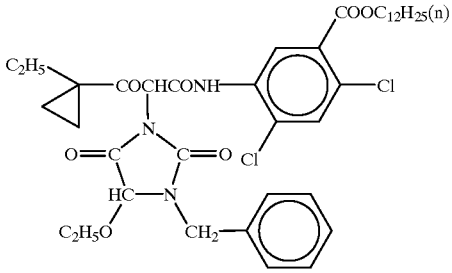
ExY-4
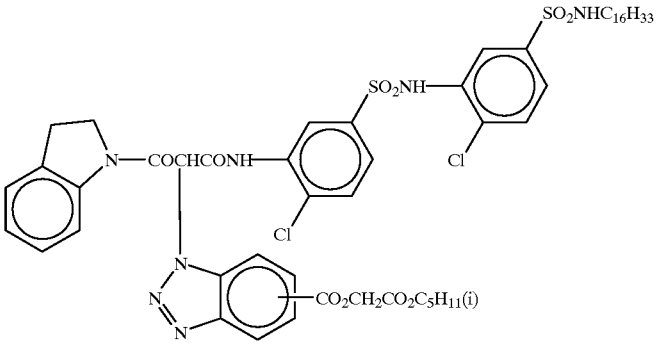
ExY-5
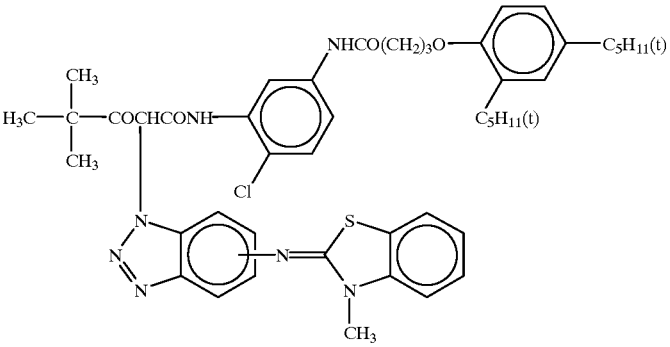
ExY-6
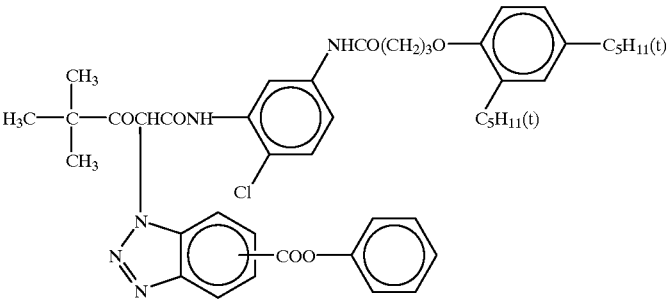

-continued
ExG-1
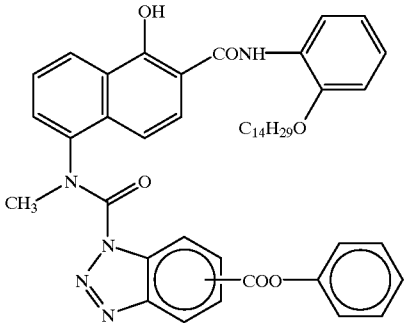
ExF-1
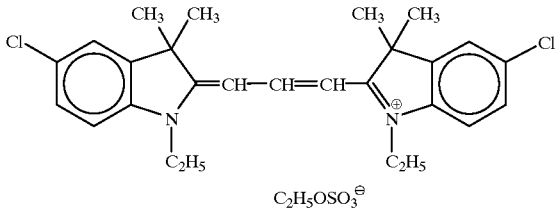
ExF-2
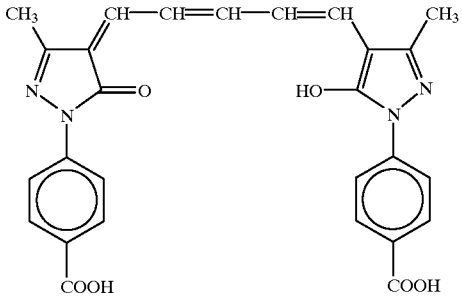
ExF-3
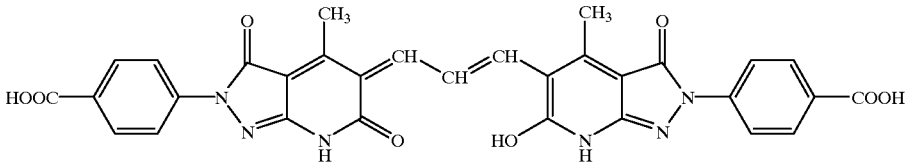
ExF-4
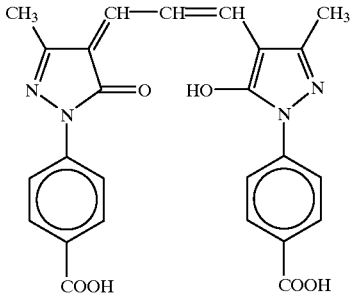
ExF-5
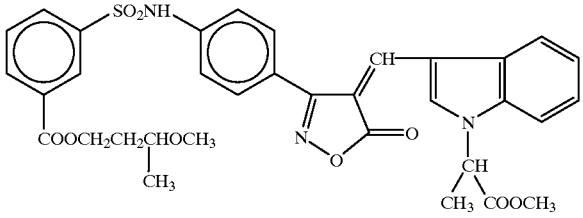

-continued
ExF-6
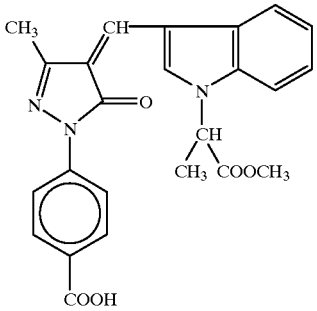
Cpd-1
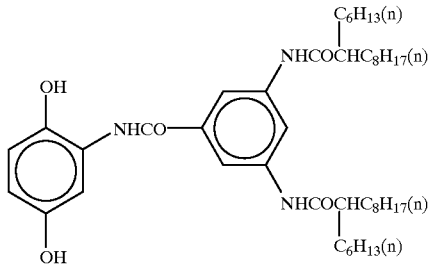
Cpd-2
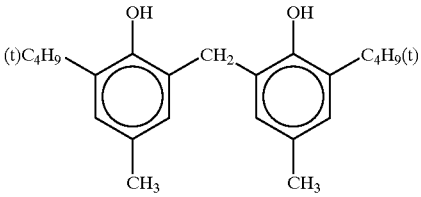
Cpd-3
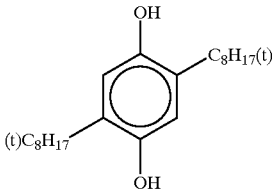
Cpd-4
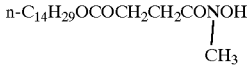
UV-1
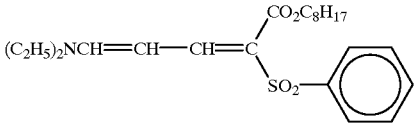
UV-2
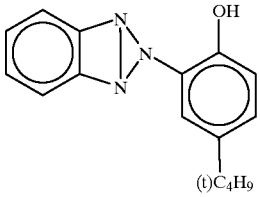
UV-3
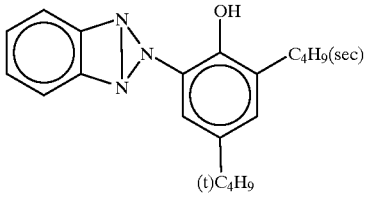
UV-4
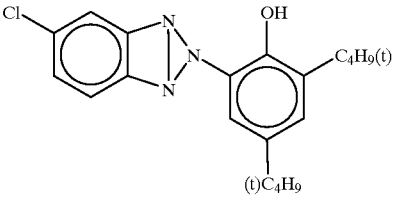
HBS-1
Tricresyl phosphate
HBS-2
Di-n-butyl phthalate
HBS-3
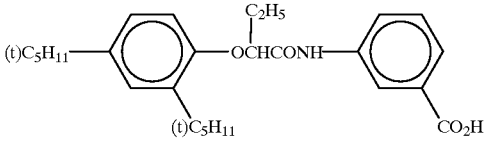
HBS-4
Tri(2-ethylhexyl) phosphate
H-1
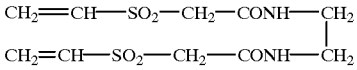
S-1
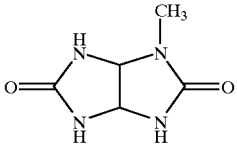
B-1
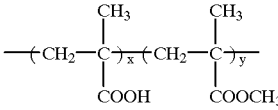
x/y = 10/90 (Weight ratio)
Average mol. wt.: about 35,000

-continued
B-2
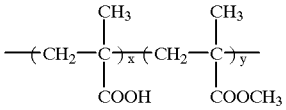
x/y = 40/60 (Weight ratio)
Average mol. wt.: about 20,000
B-3
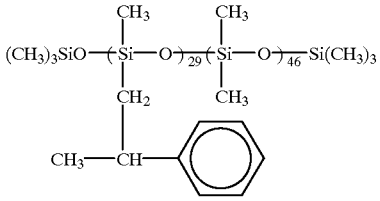
(Molar ratio)
Average mol. wt.: about 8,000
B-4
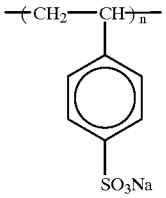
Average mol. wt.: about 750,000
B-5
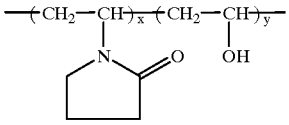
x/y = 70/30 (Weight ratio)
Average mol. wt.: about 17,000
B-6
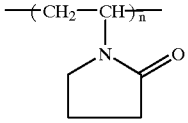
Average mol. wt.: about 10,000
W-1
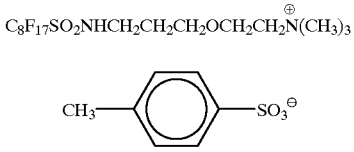
W-2
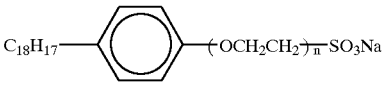
n = 2–4
W-3
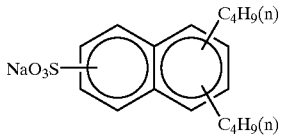
W-4
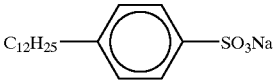
W-5
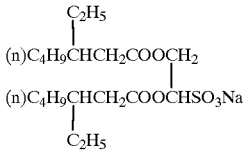
F-1
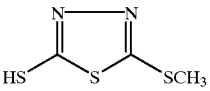
F-2
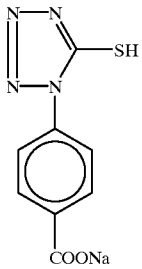
F-3
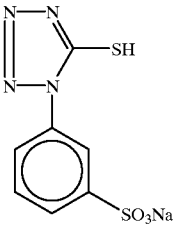
F-4
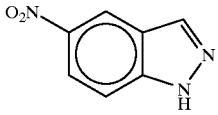

-continued

F-5

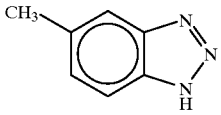

F-6

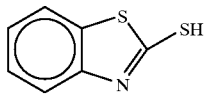

F-7

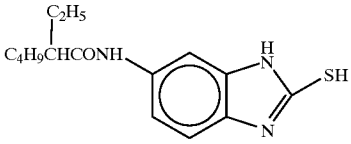

F-8

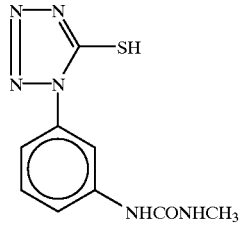

F-9

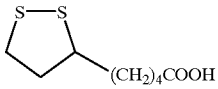

F-10

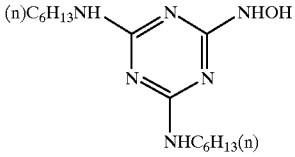

F-11

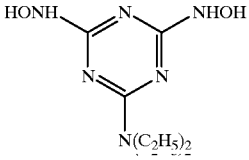

F-12

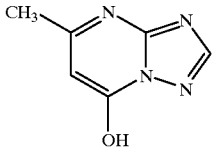

F-13

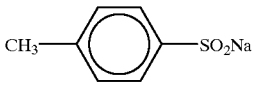

F-14

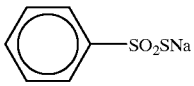

F-15

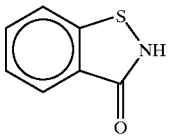

F-16

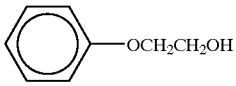

F-17

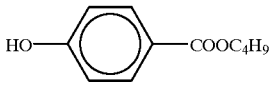

F-18

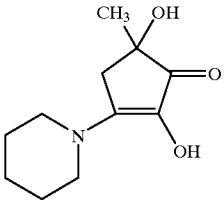

F-19

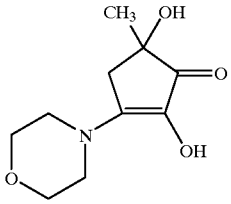

Emulsions H-2 to H-6 were prepared in the same way as in emulsions A-2 to A-6, respectively, except that the similar changes made on emulsion A-1 in order to prepare emulsion H-1 were applied to emulsions A-2 to A-6, respectively. Samples 202 to 206 were prepared in the same manner as Sample 201, except that emulsion H-1 used in the 11th layer was replaced with emulsions H-2 to H-6, respectively.

These samples were subjected to film hardening for 14 hr at 40° C. and a relative humidity of 70%. After that, the samples were exposed for 1/100 sec through a gelatin filter SC-39 (a long-wavelength light transmitting filter having a cutoff wavelength of 390 nm) manufactured by Fuji Photo Film Co., Ltd. and a continuous wedge. The development was done as follows by using an automatic processor FP-360B manufactured by Fuji Photo Film Co., Ltd. Note that the processor was remodeled so that the overflow solution of the bleaching bath was not carried over to the following bath, but all of it was discharged to a waste fluid tank. The FP-360B processor was loaded with evaporation compensation means described in Journal of Technical Disclosure No. 94-4992.

The processing steps and the processing solution compositions are presented below.

(Processing steps)

| Step | Time | Temperature | Replenishment rate* | Tank volume |
|---|---|---|---|---|
| Color development | 3 min 5 sec | 37.8° C. | 20 mL | 11.5 L |
| Bleaching | 50 sec | 38.0° C. | 5 mL | 5 L |
| Fixing (1) | 50 sec | 38.0° C. | — | 5 L |
| Fixing (2) | 50 sec | 38.0° C. | 8 mL | 5 L |
| Washing | 30 sec | 38.0° C. | 17 mL | 3 L |
| Stabilization (1) | 20 sec | 38.0° C. | — | 3 L |
| Stabilization (2) | 20 sec | 38.0° C. | 15 mL | 3 L |
| Drying | 1 min 30 sec | 60° C. | | |

*The replenishment rate was per 1.1 m of a 35-mm wide sensitized material (equivalent to one 24 Ex.)

The stabilizer and the fixing solution were counterflowed in the order from (2) to (1), and all of the overflow of the washing water was introduced to the fixing bath (2). Note that the amounts of the developer carried over to the bleaching step, the bleaching solution carried over to the fixing step, and the fixer carried over to the washing step were 2.5 mL, 2.0 mL and 2.0 mL per 1.1 m of a 35-mm wide lightsensitive material, respectively. Note also that each crossover time was 6 sec, and this time was included in the processing time of each preceding step.

The opening area of the above processor for the color developer and the bleaching solution were 100 $cm^2$ and 120 $cm^2$, respectively, and the opening areas for other solutions were about 100 $cm^2$.

The compositions of the processing solutions are presented below.

| | <Tank solution> (g) | <Replenisher> (g) |
|---|---|---|
| (Color developer) | | |
| Diethylenetriamine pentaacetic acid | 3.0 | 3.0 |
| Disodium catecohl-3,5-disulfonate | 0.3 | 0.3 |
| Sodium sulfite | 3.9 | 5.3 |
| Potassium carbonate | 39.0 | 39.0 |
| Disodium-N,N-bis (2-sulfonatoethyl) hydroxylamine | 1.5 | 2.0 |
| Potassium bromide | 1.3 | 0.3 |
| Potassium iodide | 1.3 mg | — |
| 4-hydroxy-6-methyl-1,3,3a,7 tetrazaindene | 0.05 | — |
| Hydroxylamine sulfate | 2.4 | 3.3 |
| 2-methyl-4-[N-ethyl-N-(β-hydroxyethyl)amino] aniline sulfate | 4.5 | 6.5 |
| Water to make | 1.0 L | 1.0 L |
| pH (adjusted by potassium hydroxide and surfuric acid) | 10.05 | 10.18 |
| (Bleaching solution) | | |
| Ferric ammonium 1,3-diaminopropanetetra acetate monohydrate | 113 | 170 |
| Ammonium bromide | 70 | 105 |
| Ammonium nitrate | 14 | 21 |
| Succinic acid | 34 | 51 |
| Maleic acid | 28 | 42 |
| Water to make | 1.0 L | 1.0 L |
| pH (adjusted by ammonia water) | 4.6 | 4.0 |
| (Fixer (1) Tank solution) | | |
| A 5:95 mixture (v/v) of the above bleaching tank solution and the below fixing tank solution | | |
| pH 6.8 | | |
| (Fixer (2)) | | |
| Ammonium thiosulfate (750 g/L) | 240 mL | 720 mL |
| Imidazole | 7 | 21 |
| Ammonium Methanthiosulfonate | 5 | 15 |
| Ammonium Methanesulfinate | 10 | 30 |
| Ethylenediamine tetraacetic acid | 13 | 39 |
| Water to make | 1 L | 1 L |
| pH (adjusted by ammonia water and acetic acid) | 7.4 | 7.45 |

(Washing Water)

Tap water was supplied to a mixed-bed column filled with an H type strongly acidic cation exchange resin (Amberlite IR-120B: available from Rohm & Haas Co.) and an OH type basic anion exchange resin (Amberlite IR-400) to set the concentrations of calcium and magnesium to be 3 mg/L or less. Subsequently, 20 mg/L of sodium isocyanuric acid dichloride and 150 mg/L of sodium sulfate were added. The pH of the solution ranged from 6.5 to 7.5.

| (Stabilizer) | common to tank solution and replenisher (g) |
|---|---|
| Sodium p-toluenesulfinate | 0.03 |
| Polyoxyethylene-p-monononyl phenylether (average polymerization degree 10) | 0.2 |
| Sodium 1,2-benzisothiazoline-3-on | 0 .10 |
| Disodium ethylenediamine tetraacetate | 0.05 |
| 1,2,4-triazole | 1.3 |
| 1,4-bis(1,2,4-triazole-1-ylmethyl) piperazine | 0.75 |
| Water to make | 1.0 L |
| pH | 8.5 |

Evaluation of photographic properties was conducted by measuring density of the thus processed samples with a green filter. In addition, a test to evaluate pressure characteristics was conducted in accordance with Testing method A mentioned above.

TABLE 5

| Sample | Emulsion | Sensitivity | Pressure marks |
|---|---|---|---|
| 201 | H-1 | 100 | 100 |
| 202 | H-2 | 103 | 108 |
| 203 | H-3 | 113 | 102 |
| 204 | H-4 | 116 | 100 |
| 205 | H-5 | 117 | 102 |
| 206 | H-6 | 125 | 100 |

In accordance with the present invention, highly sensitive silver halide photographic emulsions ensuring a reduction of pressure marks, and silver halide photographic lightsensitive materials containing the same can be obtained.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide photographic emulsion comprising silver halide grains, wherein 50% or more of the total number of all the silver halide grains are occupied by tabular grains, each of which satisfying the following requirements:

(i) composed of silver iodobromide or silver chloroiodobromide, and having (111) faces as main planes;

(ii) having an equivalent circle diameter of 1.0 μm or more and a thickness of 0.1 μm or less;

(iii) having 10 or more dislocation lines at a fringe portion thereof; and (iv) composed of a core portion substantially not containing any dislocation line and a shell portion containing dislocation lines, and the shell portion having a thickness of 0.01 μm or more as measured in a direction perpendicular to the main plane.

2. The silver halide photographic emulsion according to claim 1, wherein the thickness of the shell portion defined in the item (iv) is 0.015 μm or more.

3. The silver halide photographic emulsion according to claim 2, wherein a variation coefficient of the distribution of equivalent circle diameters of all the silver halide grains is 30% or less.

4. The silver halide photographic emulsion according to claim 2, wherein a variation coefficient of the distribution of equivalent circle diameters of all the silver halide grains is 25% or less.

5. The silver halide photographic emulsion according to claim 2, wherein a variation coefficient of the distribution of thicknesses of all the silver halide grains is 20% or less.

6. The silver halide photographic emulsion according to claim 2, wherein the dislocation lines were formed by the use of silver iodide fine grains.

7. The silver halide photographic emulsion according to claim 1, wherein the ratio of the tabular grains, each of which satisfying the requirements (i) to (iv), to the total number of all the silver halide grains is 70% by number or more.

8. The silver halide photographic emulsion according to claim 1, wherein the thickness defined in item (ii) is 0.07 μm or less.

9. The silver halide photographic emulsion according to claim 1, wherein the number of dislocation lines per grain defined in item (iii) is 30 or more.

10. The silver halide photographic emulsion according to claim 1, wherein a variation coefficient of the distribution of equivalent circle diameters of all the silver halide grains is 30% or less.

11. The silver halide photographic emulsion according to claim 10, wherein a variation coefficient of the distribution of thicknesses of all the silver halide grains is 20% or less.

12. The silver halide photographic emulsion according to claim 11, wherein the dislocation lines were formed by the use of silver iodide fine grains.

13. The silver halide photographic emulsion according to claim 1, wherein a variation coefficient of the distribution of equivalent circle diameters of all the silver halide grains is 25% or less.

14. The silver halide photographic emulsion according to claim 1, wherein a variation coefficient of the distribution of thicknesses of all the silver halide grains is 20% or less.

15. The silver halide photographic emulsion according to claim 14, wherein the dislocation lines were formed by the use of silver iodide fine grains.

16. A silver halide photographic lightsensitive material comprising at least one lightsensitive silver halide emulsion layer on a support, wherein the lightsensitive silver halide emulsion layer contains the silver halide photographic emulsion according to claim 1.

17. The silver halide photographic emulsion of claim 1, wherein 50% or more of the total number of silver halide grains consist of tabular grains having an aspect ratio of 10 or more.

18. The silver halide photographic emulsion of claim 17, wherein 50% or more of the total number of silver halide grains consist of tabular grains having an aspect ratio of 15 or more.

19. The silver halide photographic emulsion of claim 1, wherein twin spacing of the tabular grains is 0.014 μm or less.

20. A silver halide photographic emulsion, comprising silver halide grains, wherein 50% or more of the total number of all the silver halide grains are occupied by tabular grains, each of which satisfying the following requirements:

(i) composed of silver iodobromide or silver chloroiodobromoide, and having (111) faces as main planes;

(ii) having an equivalent circle diameter of 1.0 μm or more and a thickness of 0.1 μm or less;

(iii) having 10 or more dislocation lines at a fringe portion thereof, wherein the fringe portion of the tabular grains is the outside area of an imaginary circle whose center is located at the center of the grain and whose radius is 60% of the length of the shortest perpendicular line of perpendicular lines drawn from the center of the grain to each side of the grain; and (iv) composed of a core portion substantially not containing any dislocation line and a shell portion containing dislocation lines, and the shell portion having a thickness of 0.01 μm or more as measured in a direction perpendicular to the main plane.

21. The silver halide photographic emulsion of claim 1, wherein the thickness of the shell portion defined in item (iv) is 0.015 μm or more, and wherein the ratio of the tabular grains, each of which satisfying the requirements of (i) to (iv), to the total number of all the silver halide grains is 70% by number or more.

* * * * *